US006412678B2

(12) United States Patent
Gracyalny et al.

(10) Patent No.: US 6,412,678 B2
(45) Date of Patent: Jul. 2, 2002

(54) SHEET MATERIAL DISPENSING APPARATUS AND METHOD

(75) Inventors: Dale T. Gracyalny, Appleton, WI (US); David Carpenter, Pepperel, MA (US); Kamala Grasso, Wayland, MA (US); Douglas W. Johnson, Appleton, WI (US); Peter D. Johnson, Aurora, IL (US); John E. Longan, Shrewsbury, MA (US); John R. Moody, Neenah, WI (US); Hugh L. Smith, West Roxbury; Ronald J. Vish, Somerville, both of MA (US)

(73) Assignee: Fort James Corporation, Richmond, VA (US)

( * ) Notice: Subject to any disclaimer, the term of this patent is extended or adjusted under 35 U.S.C. 154(b) by 0 days.

(21) Appl. No.: 09/842,830

(22) Filed: Apr. 27, 2001

Related U.S. Application Data

(62) Division of application No. 09/017,325, filed on Feb. 2, 1998.

(51) Int. Cl.[7] ..... B26F 3/02

(52) U.S. Cl. ..... 225/2; 225/16; 225/34; 225/46; 225/51; 225/67

(58) Field of Search ..... 225/2, 16, 34, 225/46, 51, 67; 242/560

(56) References Cited

U.S. PATENT DOCUMENTS

| | | | |
|---|---|---|---|
| 390,328 | A | 10/1888 | Wheeler |
| 1,026,128 | A | 4/1912 | Rydquist |
| 1,414,443 | A | 5/1922 | Steiner |
| 2,067,760 | A | 1/1937 | Harvey |
| 2,299,301 | A | 10/1942 | Britt et al. |
| 2,328,109 | A | 8/1943 | Thompson |
| 2,334,689 | A | 11/1943 | Wooster |

(List continued on next page.)

FOREIGN PATENT DOCUMENTS

| | | |
|---|---|---|
| CA | 1121769 | 4/1982 |
| CA | 1137935 | 12/1982 |
| CA | 1154411 | 9/1983 |
| CA | 1117917 | 2/1984 |
| CA | 1176609 | 10/1984 |
| CA | 1211740 | 9/1986 |
| CA | 1230865 | 12/1987 |
| CA | 2011272 | 3/1990 |
| CA | 1269351 | 5/1990 |
| CA | 1288395 | 9/1991 |
| CA | 2014209 | 10/1991 |
| CA | 2036306 | 2/1992 |
| CA | 1301712 | 5/1992 |
| CA | 2039382 | 9/1992 |
| CA | 1311222 | 12/1992 |
| CA | 2073931 | 1/1993 |
| CA | 2116671 | 3/1993 |
| CA | 2067970 | 8/1993 |
| CA | 2090776 | 11/1993 |

(List continued on next page.)

*Primary Examiner*—M. Rachuba
(74) *Attorney, Agent, or Firm*—Finnegan, Henderson, Farabow, Garrett & Dunner, LLP

(57) ABSTRACT

A dispensing apparatus and method are disclosed for dispensing sheet material from at least one roll of the sheet material. Dispensing is transferred from a stub roll to a reserve roll automatically in response to sensing a predetermined quantity of the stub roll. An isolating element is provided to lift the reserve roll out of contact with dispensing rollers during dispensing of sheet material from the stub roll, and a nipping element is provided to nip sheet material of the reserve roll when dispensing is transferred from the stub roll to the reserve roll. A cam controls movement of both the isolating element and the nipping element. Structure is also provided for sensing the diameter of the reserve roll of sheet material and providing an indication when the reserve roll is a predetermined diameter. The dispenser is quiet and capacity efficient.

18 Claims, 24 Drawing Sheets

U.S. PATENT DOCUMENTS 2,738,934 A 3/1956 Dobkin
2,758,800 A 8/1956 McCants
2,806,591 A 9/1957 Appleton
2,924,494 A 2/1960 Sloier
2,930,664 A 3/1960 Liebisch
2,943,777 A 7/1960 Dvoracek
2,946,636 A 7/1960 Penney
3,073,541 A 1/1963 Layton et al.
3,107,957 A 10/1963 Batlas et al.
3,126,234 A 3/1964 Batlas et al.
3,163,446 A 12/1964 Muncy
3,217,953 A 11/1965 Bahnsen
3,291,354 A 12/1966 Ziebarth
3,294,460 A 12/1966 Wooster et al.
3,319,855 A 5/1967 Tucker et al.
3,438,589 A 4/1969 Jespersen
3,628,743 A 12/1971 Bastian et al.
3,647,158 A 3/1972 Feder
3,672,552 A 6/1972 Krueger et al.
3,690,580 A 9/1972 Jespersen
3,700,181 A 10/1972 Diring et al.
3,770,172 A 11/1973 Nystrand et al.
3,770,222 A 11/1973 Jespersen
3,771,739 A 11/1973 Nelson
3,828,996 A 8/1974 Warren
3,829,185 A 8/1974 Lloyd
3,851,810 A 12/1974 Jespersen
3,865,295 A 2/1975 Okamura
3,865,395 A 2/1975 Mathers et al.
3,917,191 A 11/1975 Graham, Jr. et al.
4,010,909 A 3/1977 Bastian
4,067,509 A 1/1978 Graham, Jr. et al.
4,106,684 A 8/1978 Hartbauer et al.
4,108,389 A 8/1978 Womack
4,137,805 A 2/1979 DeLuca et al.
4,142,431 A 3/1979 Jespersen
4,165,138 A 8/1979 Hedge et al.
4,199,090 A 4/1980 Reed
4,203,562 A 5/1980 DeLuca et al.
4,206,858 A 6/1980 DeLuca et al.
4,236,679 A 12/1980 Jespersen
4,284,402 A 8/1981 Sheets et al.
4,307,638 A 12/1981 DeLuca et al.
4,307,639 A 12/1981 DeLuca
4,317,547 A 3/1982 Graham, Jr. et al.
4,340,195 A 7/1982 DeLuca
4,358,169 A 11/1982 Filipowicz et al.
4,378,912 A 4/1983 Perrin et al.
4,396,163 A 8/1983 Graham, Jr. et al.
4,403,748 A 9/1983 Cornell
4,404,880 A 9/1983 DeLuca
4,441,392 A 4/1984 DeLuca
4,457,964 A 7/1984 Kaminstein
4,487,375 A 12/1984 Rasmussen et al.
4,520,968 A 6/1985 Shpigelman
4,522,346 A 6/1985 Jespersen
4,552,315 A 11/1985 Granger
4,611,768 A 9/1986 Voss et al.
4,616,994 A 10/1986 Tomlinson
4,620,184 A 10/1986 Nedstedt
4,627,117 A 12/1986 Morishita
4,634,192 A 1/1987 Fielding
4,659,028 A 4/1987 Wren
4,712,461 A 12/1987 Rasmussen
4,732,306 A 3/1988 Jesperson
4,756,485 A 7/1988 Bastian et al.
4,776,320 A 10/1988 Ripka et al.
4,807,824 A 2/1989 Gains et al.
4,844,361 A 7/1989 Granger
4,846,412 A 7/1989 Morand
4,856,724 A 8/1989 Jespersen
D306,384 S 3/1990 Morand
4,944,466 A 7/1990 Jespersen
4,974,783 A 12/1990 Campbell
5,009,313 A 4/1991 Morand
5,041,317 A 8/1991 Greyvenstein
5,048,386 A 9/1991 DeLuca et al.
5,058,792 A 10/1991 Morand
D321,803 S 11/1991 Dawson
D324,618 S 3/1992 Morand
D324,969 S 3/1992 Morand
5,100,075 A 3/1992 Morand
D325,142 S 4/1992 Morand
5,131,903 A 7/1992 Levine et al.
5,135,179 A 8/1992 Morano
5,172,840 A 12/1992 Bloch et al.
5,174,518 A 12/1992 Hongo et al.
5,205,454 A 4/1993 Schutz et al.
5,211,308 A 5/1993 Decker et al.
5,215,211 A 6/1993 Eberle
5,219,092 A 6/1993 Morand
5,236,753 A 8/1993 Gaggero et al.
D339,705 S 9/1993 Howard et al.
5,244,161 A 9/1993 Wirtz-Odenthal
D340,822 S 11/1993 Morand
5,266,371 A 11/1993 Sugii et al.
D341,970 S 12/1993 Brandenburg
D342,407 S 12/1993 Morand
5,271,574 A 12/1993 Formon et al.
5,288,032 A 2/1994 Boone et al.
5,294,192 A 3/1994 Omdoll et al.
D347,135 S 5/1994 Morand
5,318,210 A 6/1994 Morand
5,335,811 A 8/1994 Morand
5,375,785 A 12/1994 Boone et al.
D356,707 S 3/1995 Morand
5,400,982 A 3/1995 Collins
D357,150 S 4/1995 Morand
5,441,189 A 8/1995 Formon et al.
D363,628 S 10/1995 McCanless
5,526,973 A 6/1996 Boone et al.
5,549,218 A 8/1996 Asmussen
5,558,302 A 9/1996 Jesperson
5,562,964 A 10/1996 Jones
5,566,873 A 10/1996 Guido
5,573,318 A 11/1996 Arabian et al.
5,604,992 A 2/1997 Robinson
5,630,526 A 5/1997 Moody
5,645,244 A 7/1997 Moody
5,676,331 A 10/1997 Weber
D385,734 S 11/1997 Mervar et al.
5,690,299 A 11/1997 Perrin et al.
5,697,576 A 12/1997 Bloch et al.
5,704,566 A 1/1998 Schutz et al.
D403,905 S 1/1999 Tramontina
6,321,963 B1 * 11/2001 Gracyalny et al. ..... 225/2

FOREIGN PATENT DOCUMENTS

CA 2075140 12/1993
CA 2092585 5/1994
CA 2154159 8/1994
CA 2183524 10/1995
CA 2162745 6/1996
CA 2218427 8/1996
CA 2199092 9/1997
CA 2212940 4/1998
DE 2706234 A1 8/1978
EP 0 319 166 6/1989
GB 1325923 8/1973

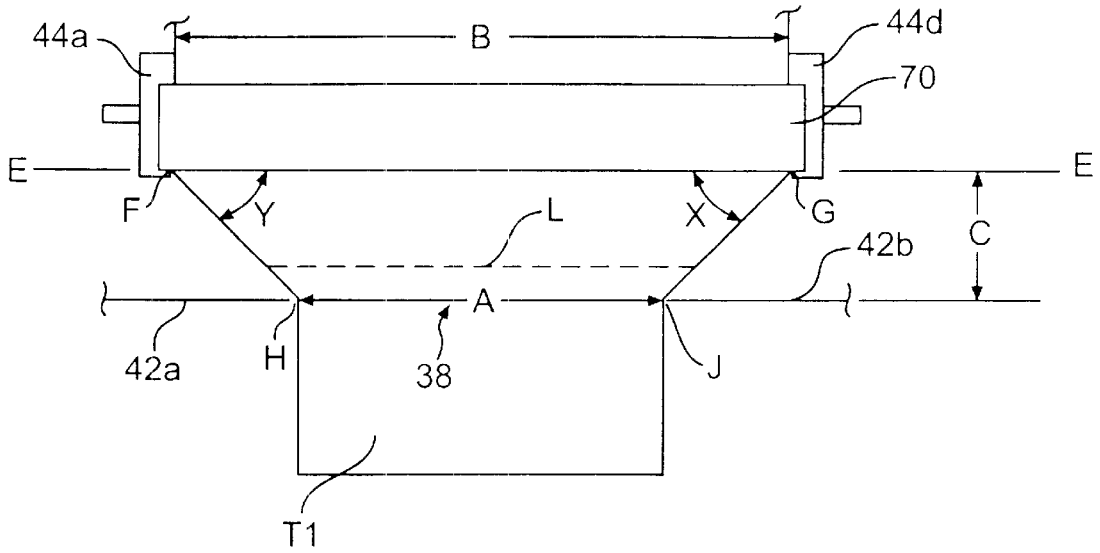
FIG. 24
FIG. 25
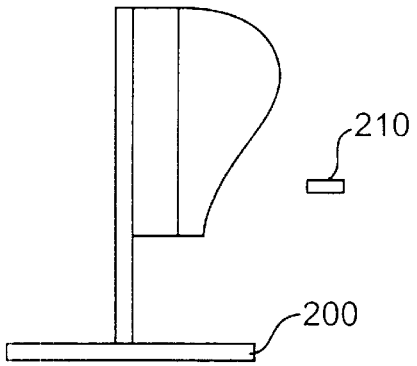
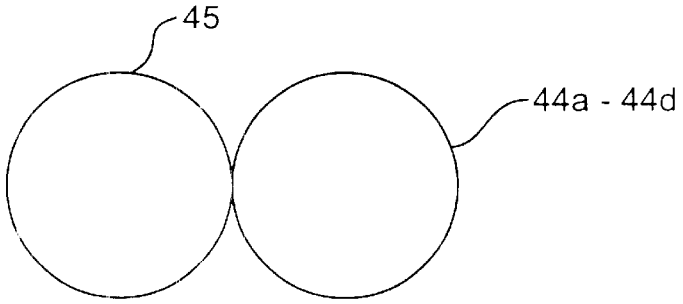
FIG. 26

SHEET MATERIAL DISPENSING APPARATUS AND METHOD

This is a division of application No. 09/017,325, filed Feb. 2, 1998 (pending), which is incorporated herein by reference.

BACKGROUND OF THE INVENTION

1. Field of the Invention

The present invention relates to a sheet material dispensing apparatus and method. More particularly, the present invention relates to an apparatus and method for dispensing sheet material from at least one source of sheet material.

2. Description of Related Art

A number of different types of sheet materials are dispensed from dispensers. Typically they are wound into a roll either with or without a core to provide a maximum amount of material in a relatively small amount of space. Some examples of these materials include paper towels, toilet tissue, wrapping paper, aluminum foil, wax paper, and plastic wrap. Rolled sheet materials are typically dispensed from dispensers having structure for allowing the roll of sheet material to rotate while the material is removed from the roll. Although these dispensers have been in existence for a long period of time, some of them have many drawbacks and disadvantages.

In many conventional dispensers for sheet material, a user must rotate a crank or move a lever each time the user desires to remove material from the dispenser. This crank or lever typically rotates a roller mechanism for feeding the sheet material from the dispenser. Although these types of dispensers are effective at dispensing sheets of material, a user must make physical contact with the crank or lever each time the user desires to dispense the sheet material from the dispenser. For example, during a single day in an extremely busy washroom, hundreds or even thousands of users may physically contact a dispenser to dispense paper toweling therefrom. This leads to possible transfer of germs and a host of other health concerns associated with the spread of various contaminants from one user to another.

Another problem associated with conventional dispensers is that of maintaining an adequate supply of the rolled sheet material in the dispenser. In one type of dispensing system, a housing contains a single roll of material during dispensing. This type of dispenser requires frequent monitoring by a service attendant to determine when substantially all of the material has been dispensed so that a new roll of material may be loaded in the dispenser. When the new roll is loaded, the partially consumed roll is often discarded in place of the new roll, resulting in the waste of a significant amount of usable material left on the partially consumed roll.

In an attempt at solving the problem of maintaining an adequate supply of sheet material, some conventional dispensers have a transfer mechanism allowing for subsequent dispensing from multiple rolls of sheet material. Although these types of dispensers are sometimes effective at dispensing substantially all of the material from each of the rolls, they are often very complex, leading to increased cost and reduced reliability.

Lack of control of the length of material dispensed is another problem associated with some conventional dispensers. For example, some conventional dispensers include a cutter allowing a user to select a particular length of sheet material before cutting it away from the remainder of the roll of material. Because a continuous sheet of material can be rapidly removed from these types of dispensers, more material than is necessary may be removed from the dispenser, resulting in waste.

In an effort to overcome these problems, conventional dispensers include automatic cutting knives or blades, which cut a predetermined length of sheet material. However, due to their design, dispensers of these types are often noisy and bulky.

Further attempts have been made to limit the amount of sheet material continuously dispensed. For example, U.S. Pat. No. 5,630,526 to Moody, and pending U.S. patent application Ser. No. 08/851,937 to Moody, filed on May 6, 1997, the entire disclosures of which are incorporated herein by reference, disclose a system for dispensing individual segments of sheet material from a roll of sheet material having perforated tear lines separating the individual segments. Pulling an end-most segment of the sheet material tears the end-most segment away from the remaining material along a perforated tear line separating the end-most segment from the remainder of the material. Although this type of dispenser is effective, additional features such as multiple roll capacity are lacking.

In light of the foregoing, there is a need in the art for an improved dispenser and method for dispensing sheet material.

SUMMARY OF THE INVENTION

Accordingly, the present invention is directed to a sheet material dispensing apparatus and method that substantially obviate one or more of the limitations of the related art.

To achieve these and other advantages and in accordance with the purpose of the invention, as embodied and broadly described herein, the invention includes an apparatus for dispensing sheet material from at least one source of sheet material. The apparatus includes a housing defining an interior including a first section for a first source of sheet material and a second section for a second source of sheet material, and an outlet though which an end portion of sheet material is dispensed from at least one of the sources. At least one nipping surface is disposed in the housing. A nipping element is pivotally mounted in the housing so that the nipping element pivots between a first position in which a first portion of the nipping element and the nipping surface form a nip for the end portion of sheet material, and a second position in which at least a second portion of the nipping element and the nipping surface form a nip for the end portion of sheet material.

In another aspect, the apparatus includes a sensor for sensing the amount of sheet material of the first source of sheet material, the sensor includes at least one cam surface moving in response to a change in size of the first source of sheet material. At least one cam follower cooperates with the nipping element. The cam follower contacts the cam surface and the cam surface moves with respect to the cam follower to control movement of the nipping element.

In an additional aspect, the apparatus includes at least one isolating element movably mounted in the housing. The isolating element moves between a second source isolating position in which the isolating element positions the second source out of contact with the nipping surface and a second source dispensing position placing the second source in contact with the nipping surface.

In another aspect, the apparatus includes a housing defining an interior for accommodating a quantity of sheet material therein and an outlet through which the sheet material is dispensed. The housing includes a first housing member, a second housing member, and at least one hinge member allowing the first housing member to pivot with respect to the second housing member between a closed position limiting access to the interior of the housing and an open position allowing access to the interior of the housing. A latch is provided on the housing for selectively retaining the first housing member in the closed position. At least one biasing element cooperates with the first and second housing members. The biasing element biases the first housing member toward the closed position when the first housing member moves to the open position so as to limit free movement of the first housing member to the open position.

In yet another aspect of the invention, the apparatus includes a housing defining an interior including a first section for a source of sheet material and a second section for the source of sheet material, the second section being larger than the first section, and an outlet through which the sheet material is dispensed. A sensor is disposed in the housing for sensing the size of the source while the source is in the second section. An indicator cooperates with the sensor to provide an indication when the size of the source is small enough to place the source of sheet material in the first section of the housing.

In a further aspect, the apparatus includes a lever pivotally coupled to the housing and cooperating with a roller so that pivoting of the lever rotates the roller, the lever being located with respect to the outlet so that sheet material dispensed through the outlet passes substantially over the lever.

In another aspect, the present invention includes a method of dispensing sheet material, including dispensing sheet material from the first source, the dispensing including passing an end portion of sheet material from the first source through a nip formed between the nipping element and the nipping surface and through the outlet. The nipping element is moved with respect to the nipping surface to place an end portion of sheet material from the second source in the nip formed between the nipping element and the nipping surface. The method also includes dispensing sheet material from the second source, the dispensing of sheet material from the second source including passing the end portion of the sheet material from the second source through the nip and through the outlet.

In another aspect, the method includes the steps of positioning the second source away from the nipping surface and dispensing sheet material from the first source, the dispensing including passing an end portion of sheet material from the first source through a nip formed between the nipping element and the nipping surface and through the outlet. The quantity of the first source is sensed and the second source is placed in contact with the nipping surface when a predetermined quantity of the first source is sensed. The method also includes dispensing sheet material from the second source, the dispensing of sheet material from the second source including passing an end portion of sheet material from the second source through the nip and through the outlet.

In another aspect, the method includes the steps of sensing the quantity of a source of sheet material in the second section and providing an indication when the quantity of the source is small enough to place the source in the first section of the housing interior.

In a further aspect of the invention, the apparatus includes a contacting element for contacting an outer surface of a stub roll to apply a force capable of resisting rotational movement of the stub roll and preventing translational movement of the stub roll throughout the dispensing of sheet material from the stub roll.

In an even further aspect of the invention, there is provided a system including a dispenser and at least two rolls of sheet material having a width of at least about 5 inches. The system is capable of dispensing a single segment of the sheet material by a user grasping only the sheet material of the system, and the dispensing of a single segment of the sheet material produces a maximum sound level below about 81 decibels.

In another aspect of the invention, there is provided a system including a dispenser and at least two rolls of sheet material having a width of at least about 5 inches. The system is capable of dispensing a single segment of the sheet material by a user grasping only the sheet material of the system, and the ratio, expressed as a percentage, of the maximum sheet material volume to the total enclosed volume of the dispenser is at least about 35%.

In yet another aspect of the invention, the nip and the outlet are configured such that at least one angle defined by a first line extending along an exit of the nip and a second line formed between the outermost lateral exit end of the nip along the first line that contains the sheet material and the point of contact between the sheet material and the edge of the outlet is from about 26° to about 39°, and the closest point on a line extending along an exit of the nip is spaced a distance of from about 0.1 inch to about 3 inches to the point of contact between the sheet material and the edge of the outlet.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

FIG. 24 is a schematic internal front view showing sheet material passing through a nip and the outlet of the apparatus;

FIG. 25 is a partially schematic side view showing testing conditions for measuring sound level during dispensing from the apparatus; and FIG. 26 is a schematic side view of an alternate embodiment of the apparatus in which mating rollers form a nip for sheet material.

DESCRIPTION OF THE PREFERRED EMBODIMENTS

Figure 1:
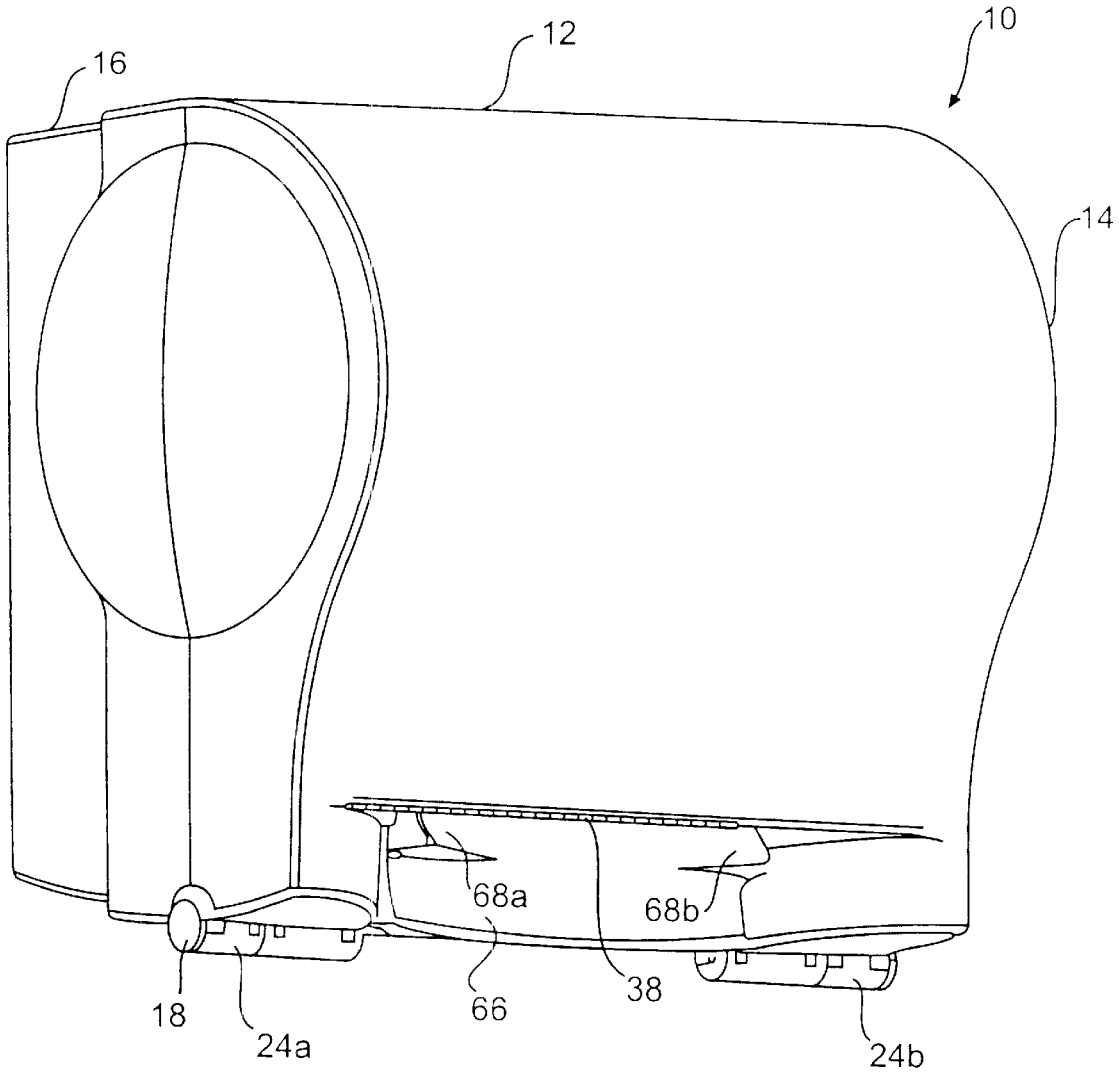
FIG. 1 is a front perspective view of the sheet material dispensing apparatus with a front cover of the apparatus in a closed position.

Reference will now be made in detail to the present preferred embodiments of the invention, examples of which are illustrated in the accompanying drawings. Wherever possible, the same reference numbers are used in the drawings and the description to refer to the same parts.

Figure 2:
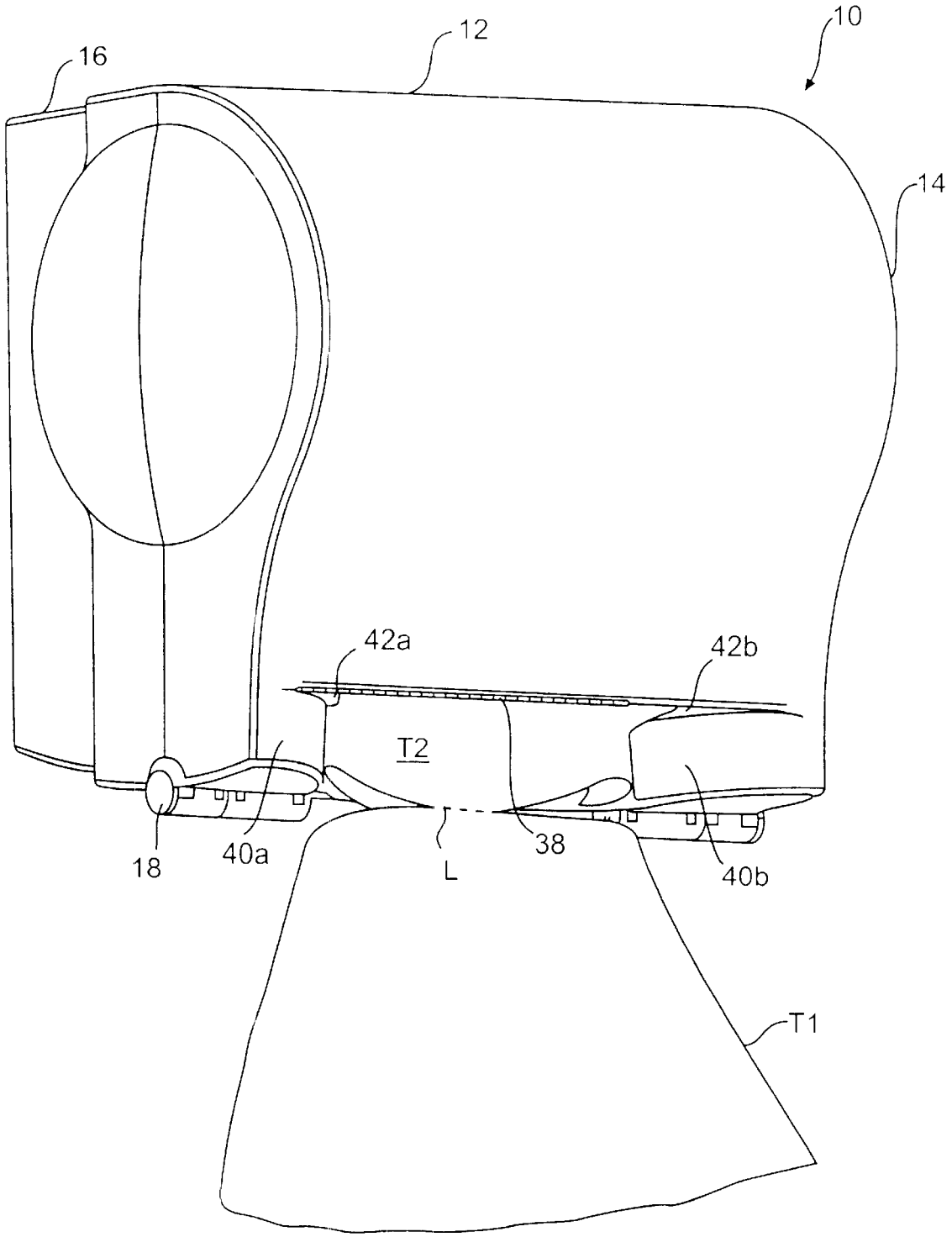
FIG. 2 is a front perspective view of the apparatus illustrating sheet material being dispensed through a dispensing outlet in the front cover.
Figure 3A:
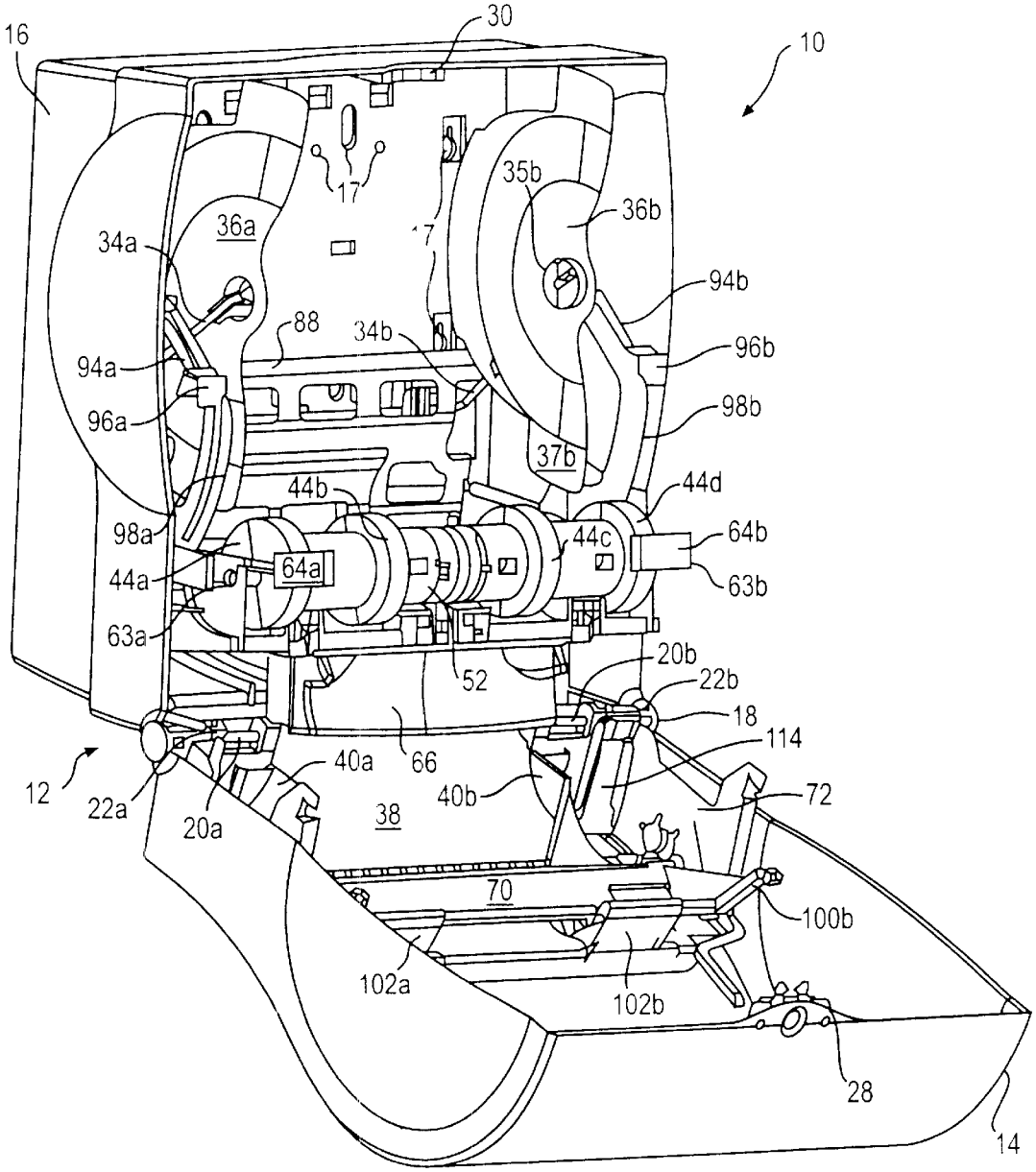
FIG. 3*a* is a front perspective view of the apparatus with the front cover opened to reveal the interior of a housing of the apparatus.

In accordance with the invention, there is provided an apparatus for dispensing sheet material. As shown in FIGS. 1, 2, and 3*a*, apparatus 10 includes a housing 12 having a first housing member 14, a second housing member 16, and a hinge member 18. Preferably, the first housing member 14 is a front cover having a sheet material dispensing outlet 38 in a lower portion of the cover 14, the second housing member 16 is a rear casing, and the hinge 18 member is located at the lower portion of the front cover 14. Preferably, the rear casing 16 includes mounting holes 17, shown in FIGS. 3*a* and 7, so that the housing 12 can be secured directly or indirectly to a mounting surface with fasteners and/or a releasable mounting bracket (not shown).

The hinge member 18 allows the front cover 14 to pivot with respect to the rear casing 16 between an open position, shown in FIGS. 3*a*, 4–7, and 23, allowing access to an interior of the housing 12, and a closed position, shown in FIGS. 1, 2, and 16–22, limiting access to the interior of the housing 12. The hinge member 18 includes hinge pins 20*a* and 20*b*, shown in FIGS. 3*a*, 14, and 15, extending respectively through first hinge brackets 22*a* and 22*b* on the front cover 14 and through second hinge brackets 24*a* and 24*b*, shown in FIG. 1, on the rear casing 16. The front cover 14 pivots about a common axis of the hinge pins 20*a* and 20*b* during movement between the open position and the closed position.

Figure 14:
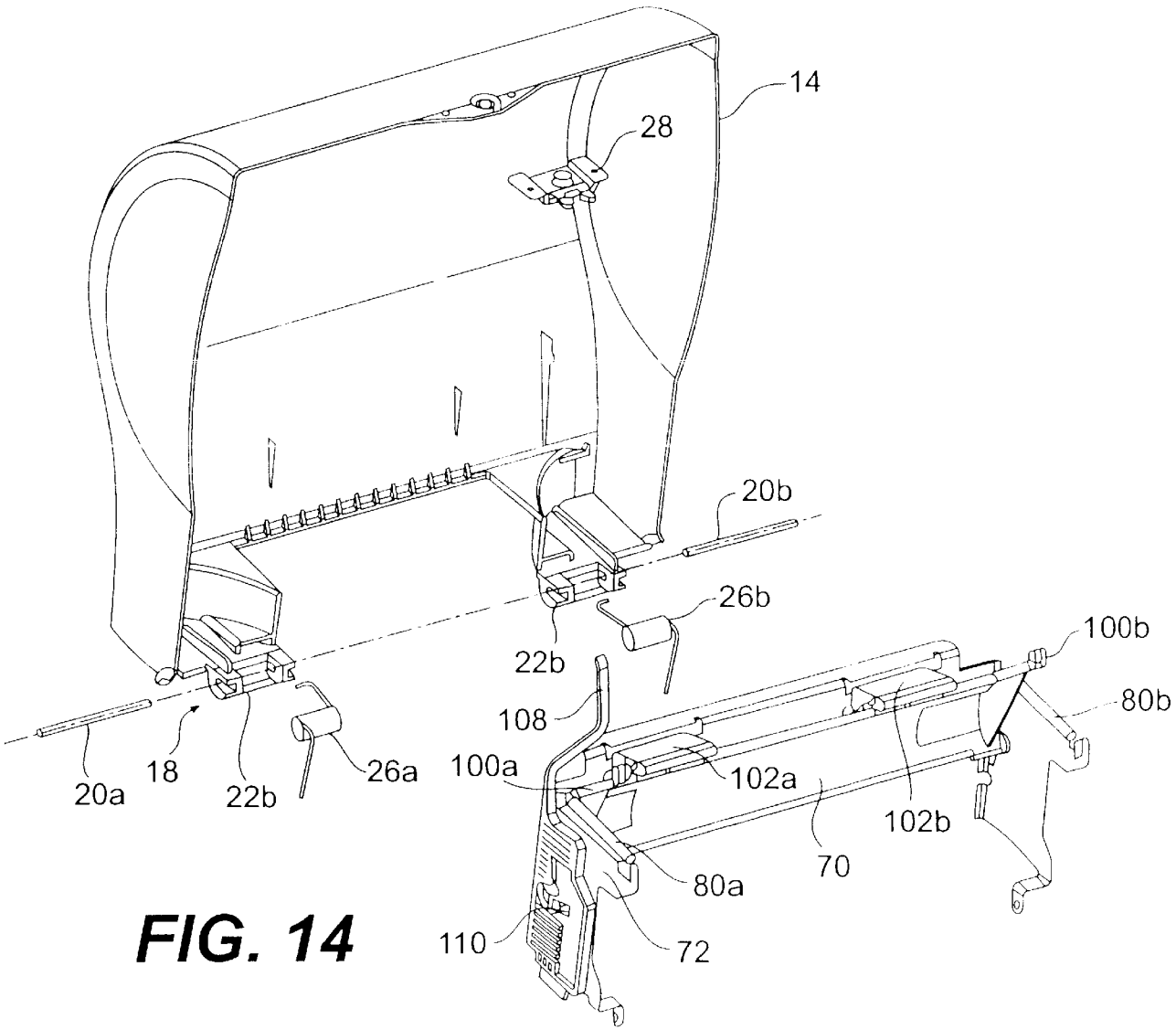
FIG. 14 is a partially exploded, perspective view of components of the front cover including the mechanism and sensor shown in FIG. 13.
Figure 15:
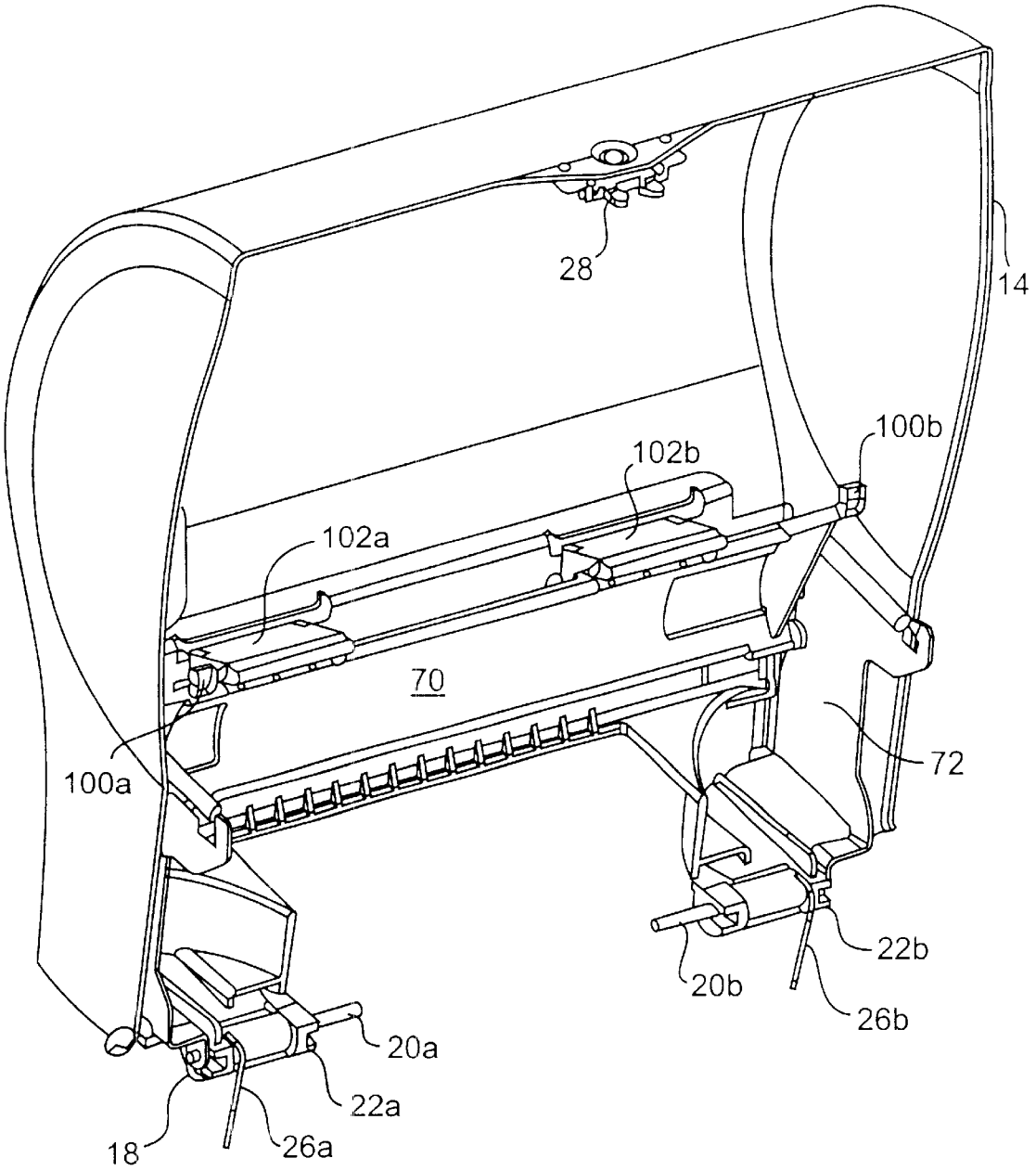
FIG. 15 is a perspective view of the front cover shown in FIG. 14.

As shown in FIGS. 14 and 15, biasing elements 26*a* and 26*b* are provided respectively about the hinge pins 20*a* and 20*b*. The biasing elements 26*a* and 26*b* are preferably torsion springs having ends contacting the rear casing 16 and the front cover 14 when the front cover 14 is connected to the rear casing 16. During movement of the front cover 14 to the open position, the biasing elements 26*a* and 26*b* rotationally bias the front cover 14 toward the closed position. This rotational biasing of the biasing elements 26*a* and 26*b* restricts free rotation of the front cover 14 toward the open position and thereby limits forcible impacting of the front cover 14 against a mounting surface when the front cover 14 is opened. In contrast to conventional dispensers, the biasing elements 26*a* and 26*b* minimize the risk of structural and/or cosmetic damage to both the front cover 14 and a mounting surface during opening of the front cover 14.

A releasable latch mechanism 28, shown in FIGS. 3*a*, 3*b*, 4–6, 14, and 15, is provided on the front cover 14 to retain the front cover 14 selectively in the closed position shown in FIG. 1. The releasable latch mechanism 28 engages a catch 30, shown in FIGS. 3*a* and 3*b*, on the top of the rear casing 16 when the front cover 14 is closed. The latch mechanism 28 and catch 30 may be any type of conventional latching structure used for dispensers. For example, the latch mechanism 28 may be a lock actuated by a corresponding key (not shown) to limit unauthorized access to the interior of the housing 12.

Preferably, the housing 12 defines an interior for accommodating one or more sources of sheet material. Each source preferably includes sheet material wound in a cylindrical shaped roll either with or without a core. Alternatively, each source of sheet material is in an accordion folded stack or any other form allowing for uninterrupted, continuous feed.

As shown in FIGS. 18–20 and 23, the housing 12 defines an interior having a section for accommodating a stub roll of sheet material S and section for accommodating a reserve roll of sheet material R. The stub roll of sheet material S rests on a lower surface of the rear casing 16. This lower surface of the rear casing 16 includes a plurality of ribs 32, shown in FIG. 7, to limit friction between the rear casing 16 and the stub roll S when the stub roll S rotates in the housing 12 during dispensing of sheet material from the stub roll. The ribs 32 also elevate the stub roll S from the bottom of the housing 12 to limit possible contact of the stub roll S with any moisture or dirt accumulated in the housing 12.

Figure 3B:
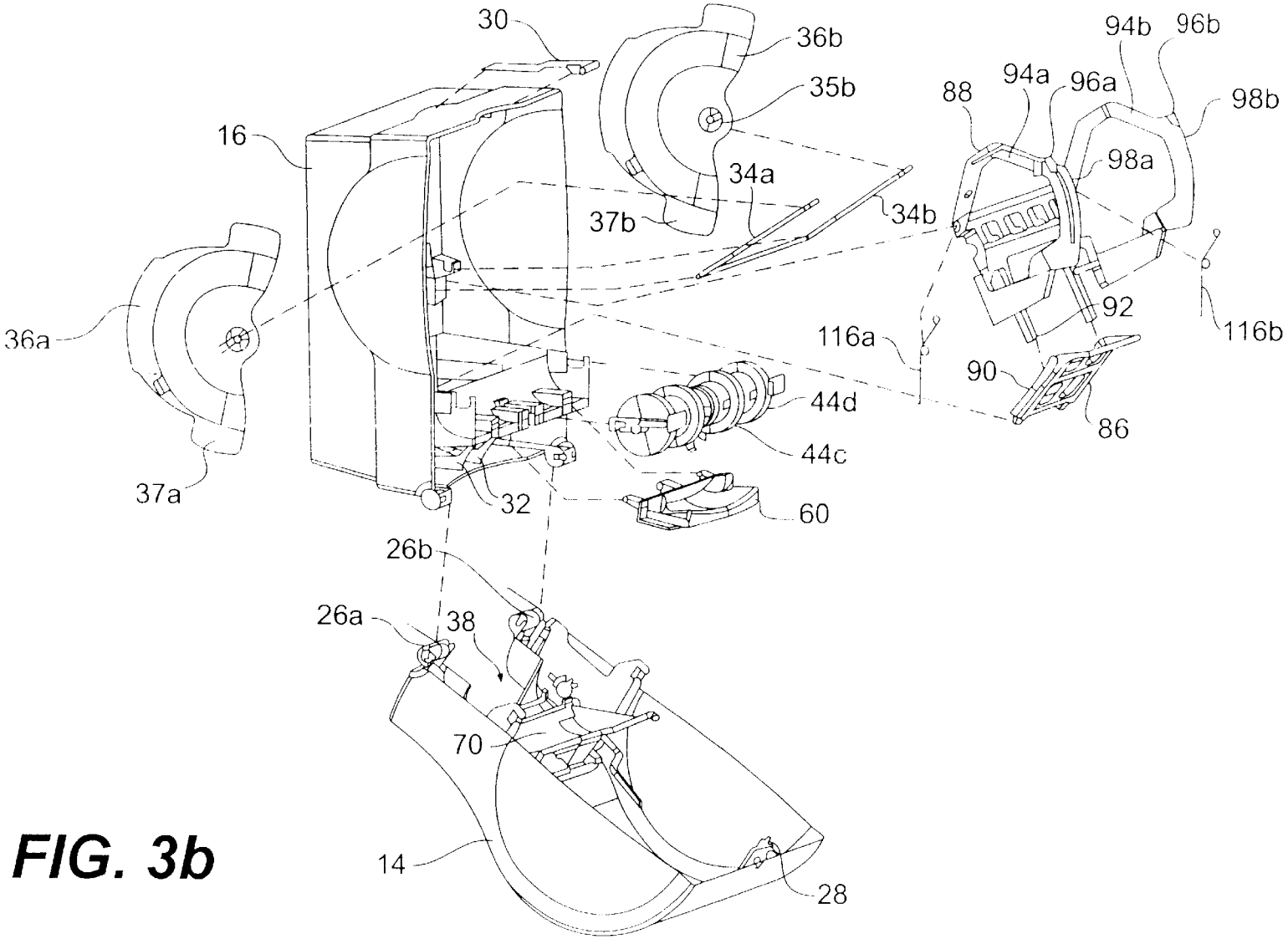
FIG. 3*b* is an exploded perspective view showing components mounted to the rear casing of the housing.
Figure 7:
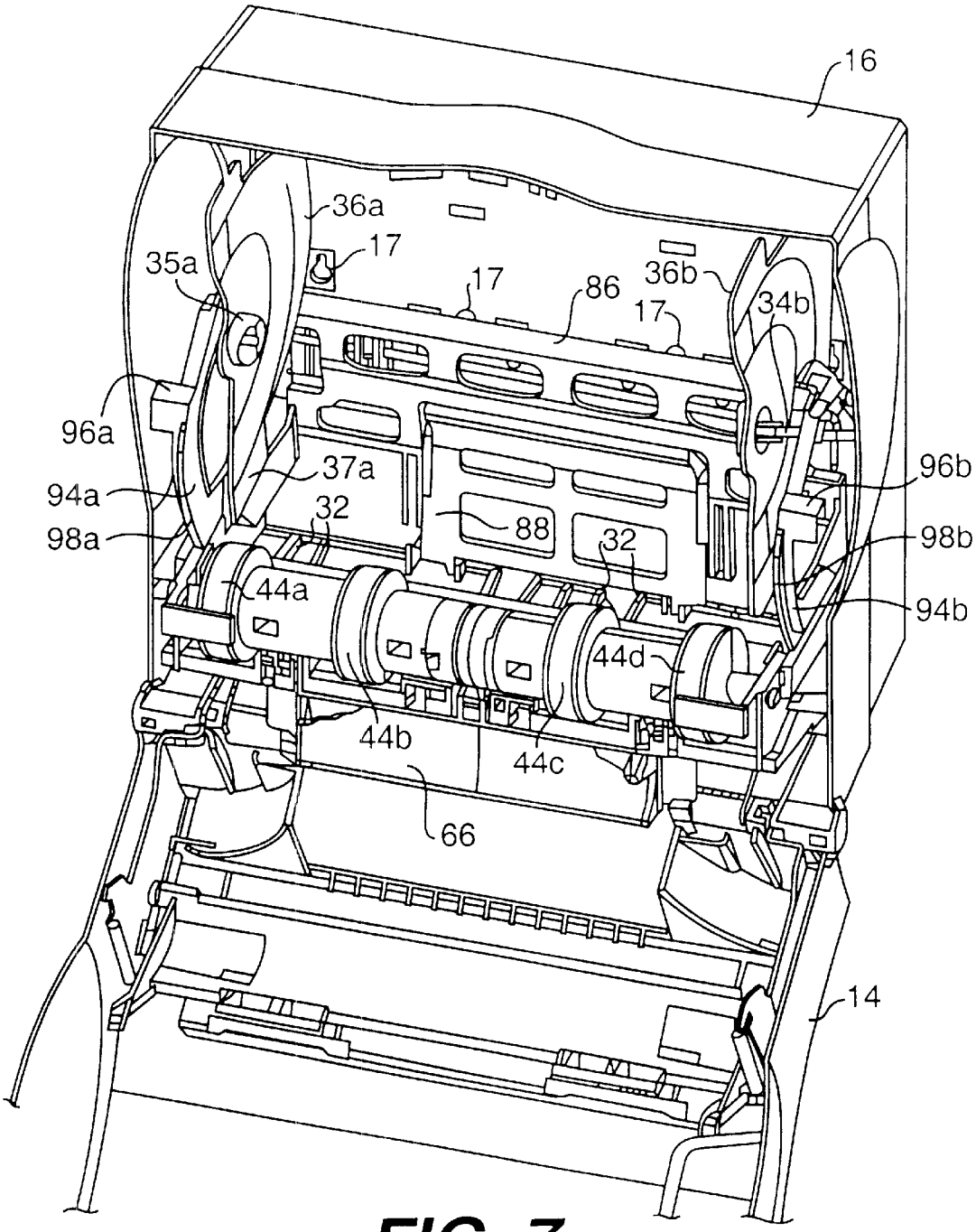
FIG. 7 is a front perspective view of the apparatus with the front cover open and a stub roll sensor in a position allowing placement of the stub roll in a section of the housing interior.
Figure 16:
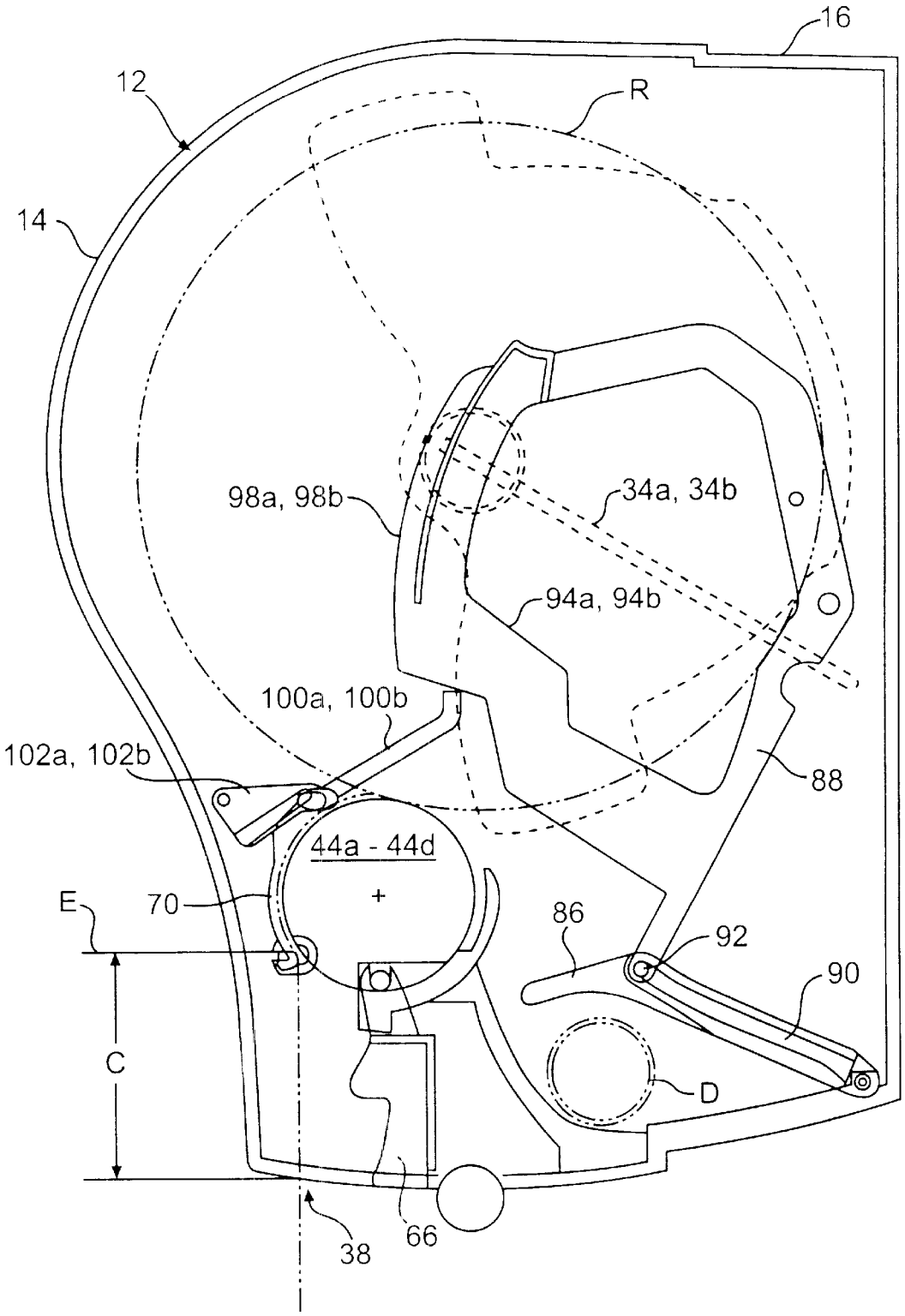
FIG. 16 is a schematic side view of the interior of the housing during initial dispensing from the reserve roll of sheet material.
Figure 17:
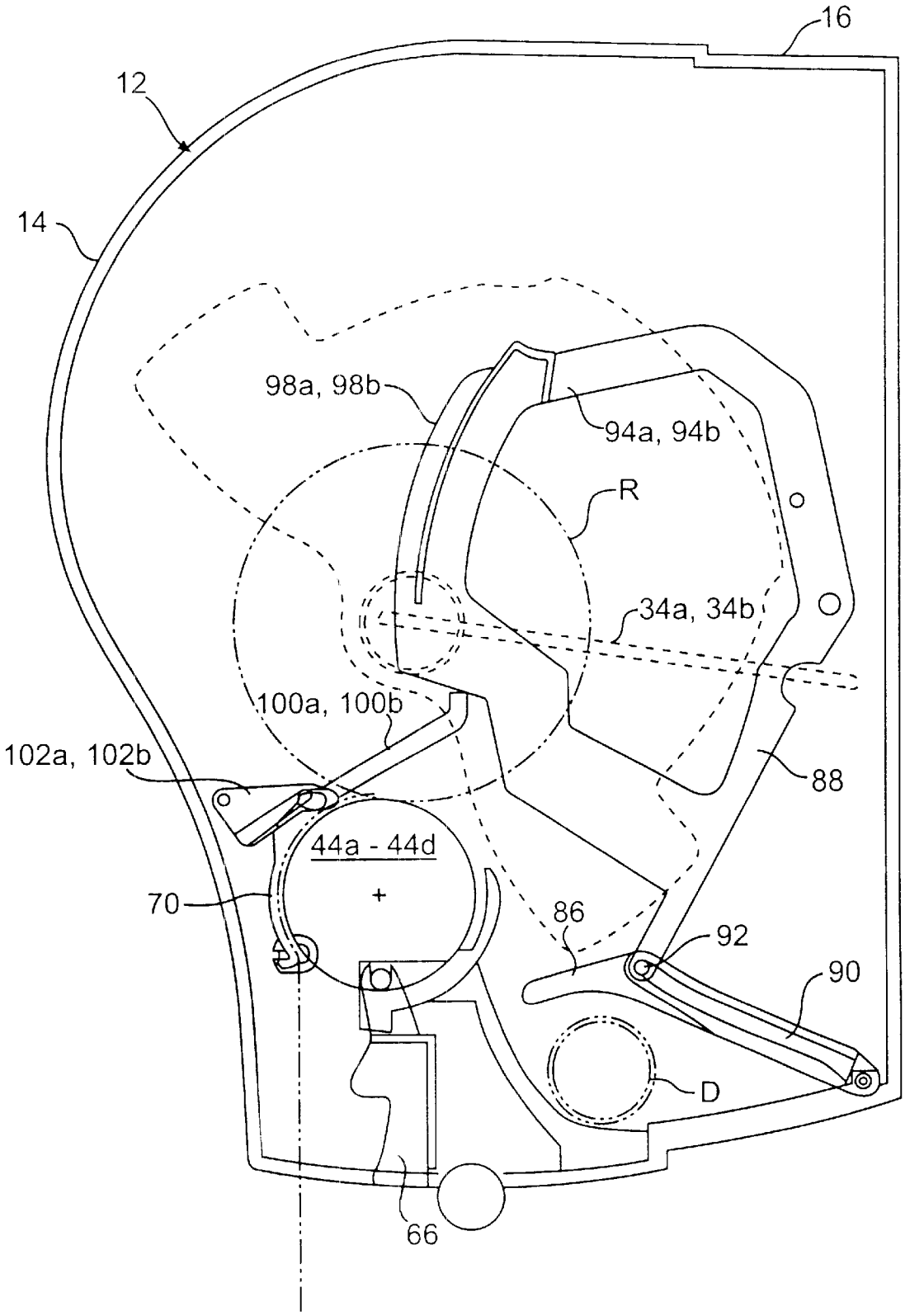
FIG. 17 is a view, similar to FIG. 16, showing dispensing from the reserve roll when the reserve roll reaches a diameter sufficient to place the reserve roll in a stub roll compartment of the housing interior.

As shown in FIGS. 3*a*, 3*b*, and 7, the interior of the housing 12 includes a pair of arms 34*a* and 34*b* having respective mounts 35*a* and 35*b* for mounting the reserve roll R in the interior of the housing 12 so that the reserve roll is placed on rollers 44*a*–44*d*, described below, during dispensing of sheet material from the reserve roll R. The arms 34*a* and 34*b* are pivotally mounted to a rear wall of the rear casing 16, as shown in FIGS. 16–22, to move the reserve roll R in an arc-shaped path during dispensing of sheet material from the reserve roll R, as shown in FIGS. 16 and 17. As shown in FIG. 3*b*, the pair of arms 34*a* and 34*b* are preferably end portions of a U-shaped wire structure mounted to the back wall of the rear casing 16 so that the pair of arms 34*a* and 34*b* pivot in unison. The mounts 35*a* and 35*b* allow the reserve roll R to rotate about its axis of rotation during dispensing of sheet material therefrom. The mounts 35*a* and 35*b* are preferably connected to end portions of the arms 34*a* and 34*b* and are shaped to fit within a core of the reserve roll R.

Tensioning elements 36*a* and 36*b*, shown in FIGS. 3*a*, 3*b*, and 7, are also connected to end portions of the arms 34*a* and 34*b*, respectively. The tensioning elements 36*a* and 36*b* each have a surface for contacting a respective end of the reserve roll R mounted in the mounts 35*a* and 35*b*. These surfaces of the tensioning elements 36*a* and 36*b* apply frictional thrust forces to opposite ends of the reserve roll R to limit free rotation of the reserve roll R and thereby induce tension in sheet material pulled from the reserve roll R during dispensing. As shown in FIGS. 3*a*, 3*b*, and 7, the tensioning elements 36*a* and 36*b* have portions 37*a* and 37*b* for extending beyond the diameter of the reserve roll R in the vicinity of where the reserve roll R contacts the rollers 44*a*–44*d* to limit lateral travel of sheet material dispensed from the reserve roll R.

In a preferred practice of the invention, each of the stub roll S and the reserve roll R is a continuous web of sheet material wound into a roll either with or without a core. The sheet material has two side edges, a terminal end, and an initial end. The sheet material is preferably divided into a plurality of individual sheets by a plurality of perforation tear lines including frangible bonds and perforations spaced along each tear line and extending from one edge to the other. The spacing and size of the frangible bonds may be constant or variable across the width of the roll. The perforation tear lines are preferably aligned substantially parallel to each other and substantially perpendicular to the edges of the roll. For example, the sheet material may be constructed like the sheet material disclosed in above mentioned U.S. Pat. No. 5,630,526, or like the sheet material disclosed in U.S. Pat. No. 5,704,566 to Schutz et al. and in pending U.S. patent application Ser. No. 08/942,771, filed on Oct. 2, 1997 to Schultz et al., the entire disclosures of which are incorporated herein by reference. Although rolls of sheet material having perforation tear lines are preferred, other types of sheet material may be used in the apparatus 10. The sheet material preferably has a width B shown in FIG. 4 (extending orthogonal to the edges of the sheet material) of from about 4 inches to about 14 inches.

Preferably, the sheet material of the reserve roll R and stub roll S is absorbent paper toweling. However, many different types of sheet material are capable of being dispensed from the apparatus 10. The sheet material may be formed in many different ways by many different processes. Sheet material can be classified as a woven material or fabric, like most textiles, or a non-woven material. For example, the sheet material could be a non-woven fabric-like material composed of a conglomeration of fibrous materials and typically non-fibrous additives. Non-wovens may be classified further into wet-formed materials and dry-formed materials. As used herein, wet-formed materials are those materials formed from an aqueous or predominantly aqueous suspension of synthetic fibers or natural fibers, such as vegetable, mineral, animal, or combinations thereof by draining the suspension and drying the resulting mass of fibers; and dry-formed materials are those materials formed by other means such as air-laying, carding, or spinbonding without first forming an aqueous suspension. Non-wovens may further include composites of wet and dry formed materials where the composite is formed such as by hydroentangling or laminating.

Preferably, the sheet material of the stub roll S and reserve roll R is constructed like the sheet material disclosed in U.S. patent application Ser. No. 09/017,482, filed on Feb. 2, 1998, entitled Perforated Sheet Material and a Dispensing System for Dispensing the Material (pending) [inventors: Douglas W. Johnson, Dale T. Gracyalny, and Thomas N. Kershaw], the entire disclosure of which is incorporated herein by reference.

As shown in FIG. 2, the sheet material is dispensed from the interior of the housing 12 via the dispensing outlet 38 in the lower portion of the front cover 14. As shown in FIGS. 2 and 41 the dispensing outlet 38 is defined at least partially by a lower edge of the front cover 14 including vertical curved walls 40*a* and 40*b* and horizontal planar walls 42*a* and 42*b*. The curved walls 40*a* and 40*b* provide ease of access to the dispensing outlet 38 and make it easier for a user to grasp an end portion of sheet material extending from the outlet 38 without touching the housing 12. End edges of the curved surfaces 40*a* and 40*b* are preferably located equidistant from the centerline of sheet material being dispensed from the outlet 38.

Preferably, the width of the dispensing outlet 38 is narrower than the width of sheet material being dispensed through the outlet 38 so that the edges of the sheet material experience increased tensile forces induced by frictional forces as the sheet material passes through the outlet 38, as shown in FIG. 2. The distance A, shown in FIGS. 4 and 24, between the edge 43*a* of the wall 42*a* and the edge 43*b* of the wall 42*b* is preferably from about 20 percent to about 90 percent of the sheet material width B, more preferably from about 55 percent to about 85 percent of the sheet material width B, even more preferably from about 65 percent to about 75 percent of the sheet material width B, and most preferably about 70 percent of the sheet material width B.

Figure 5:
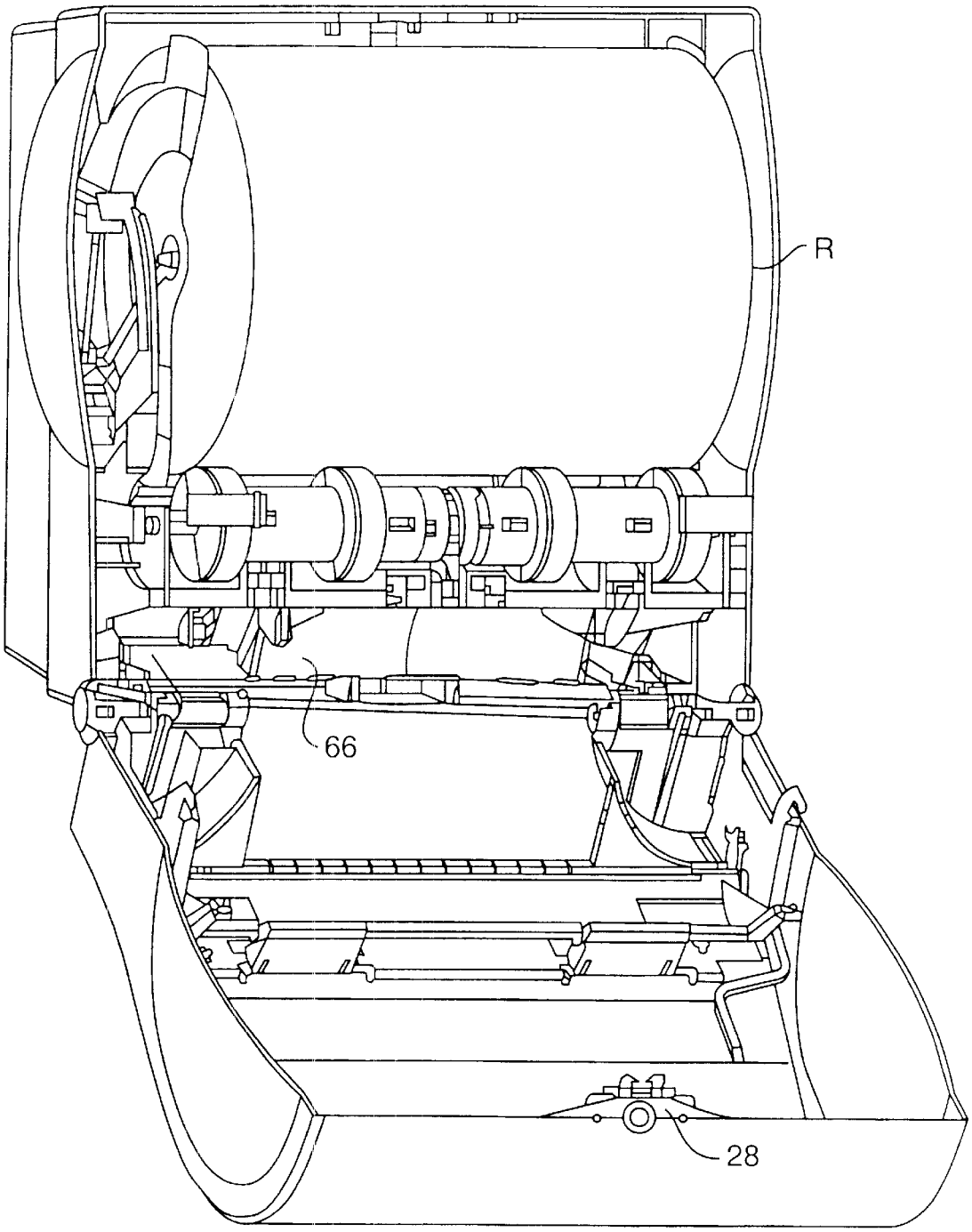
FIG. 5 is a view similar to FIG. 4 with a sheet advancing lever of the apparatus pressed toward a rear of the housing to rotate rollers.

As described below, the apparatus 10 reliably dispenses individual sheets from a wound roll of perforated sheet material without normally requiring a user to contact a portion of the apparatus 10 other than the sheet material itself. After a sheet is dispensed, a sufficient length of sheet material or tail remains exposed from the dispensing outlet 38 so the next user can easily grasp and dispense the next sheet without contacting the apparatus 10. In the event that the tail of sheet material extending from the outlet 38 is not long enough for a user to easily grasp it, a lever 66, shown in FIG. 1 and described below, can be depressed, as shown in FIG. 5, to expose additional sheet material.

FIG. 2 illustrates a sheet of the perforated sheet material being dispensed from the dispensing apparatus 10. As a user pulls the terminal end T1 of the sheet material from the dispensing outlet 38, tensile stresses are induced in the sheet material as a result of the opposed drag force and frictional forces generated within the apparatus 10. As described below, when sheet material is dispensed from the reserve roll R, the friction forces are generated by the core support mounts 35*a* and 35*b* shown in FIGS. 3*a*, 3*b*, and 7, tensioning elements 36*a* and 36*b* shown in FIGS. 3*a*, 3*b*, and 7, the weight of the roll on the outer surfaces of rollers 44*a*, 44*b*, 44*c*, and 44*d* shown in FIGS. 3*a*, 7, and 9, a nip (restricted passageway) formed between a biased nipping element 70 shown in FIGS. 3*a*, 4–7, and 13–15 and friction bands 50*a*, 50*b*, 50*c* and 50*d* shown in FIG. 8, and the edges 43*a* and 43*b* of the outlet 38. As also described below, when sheet material is dispensed from the stub roll 3, the friction forces are generated by a biased contact element 86 shown in FIGS. 3*b*, 7, and 16–23, the bottom of the compartment for the stub roll S in rear casing 16, the nip, and the outlet edges 43*a* and 43*b*.

Before the perforation tear line L reaches the narrowed outlet 38, the pulling force exceeds the drag and friction forces. When a perforation tear line L passes through and contacts the edges of the dispensing outlet 38 during pulling of the sheet material, the tensile stresses are concentrated at the edges of the sheet material. This causes the drag and friction forces to exceed the strength of the sheet material at the perforation tear line L. Separation at the perforation tear line L typically initiates from one or both of the edges of the sheet material because this is where concentrated tensile stresses exceed the maximum tensile strength of the frangible perforation bonds along the perforation tear line L. As the user continues to pull the sheet material from the dispensing apparatus 10, separation of the perforation tear line L propagates across the sheet material from the edges of the sheet material toward the center of the sheet material. Eventually, a single sheet is separated from the remainder of the sheet material, and a sufficient length of a tail of sheet material T2 remains for a subsequent user to easily grasp and dispense the next sheet.

Figure 4:
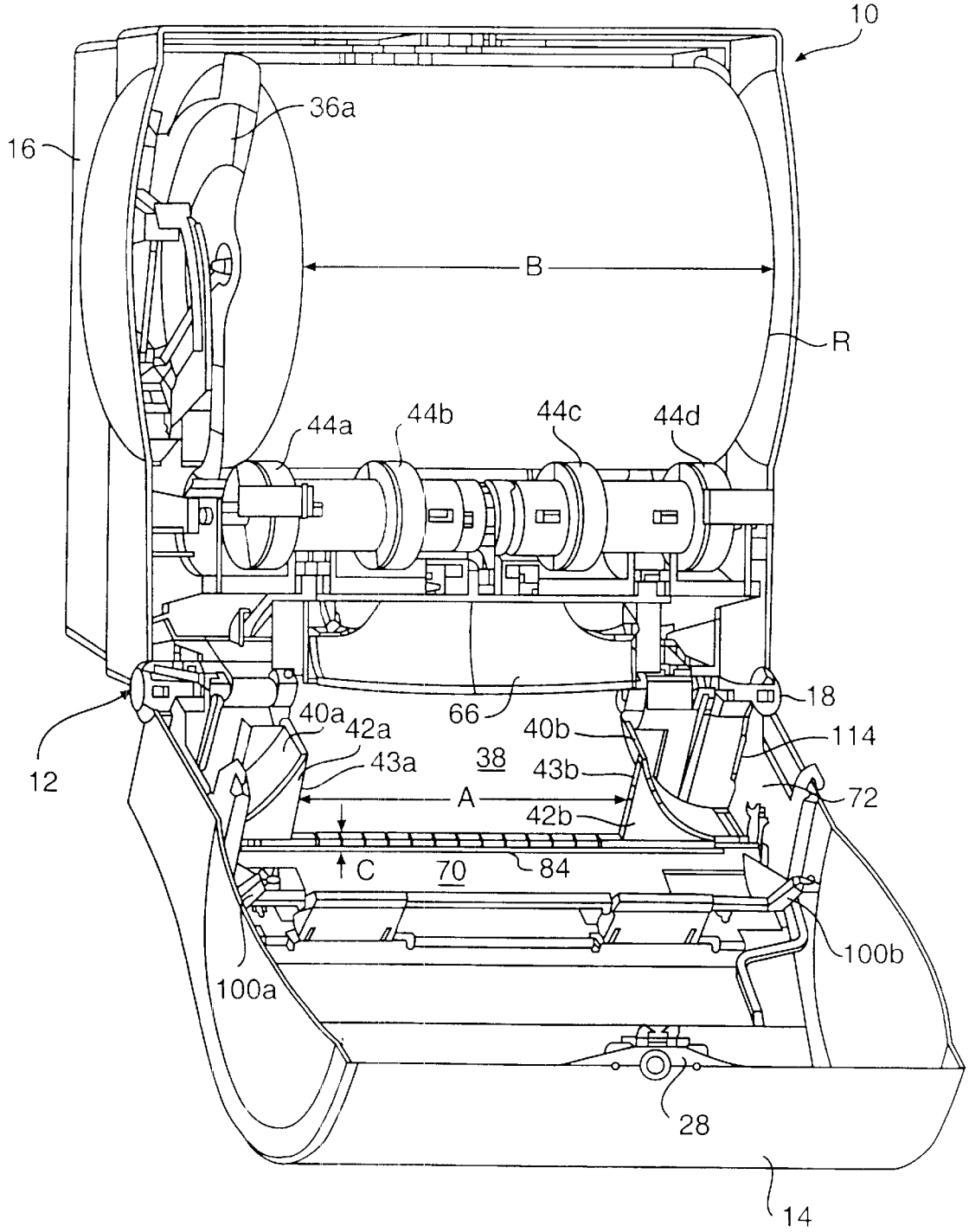
FIG. 4 is a front perspective view similar to FIG. 3*a* showing a reserve roll of sheet material accommodated in a section of the housing.
Figure 8:
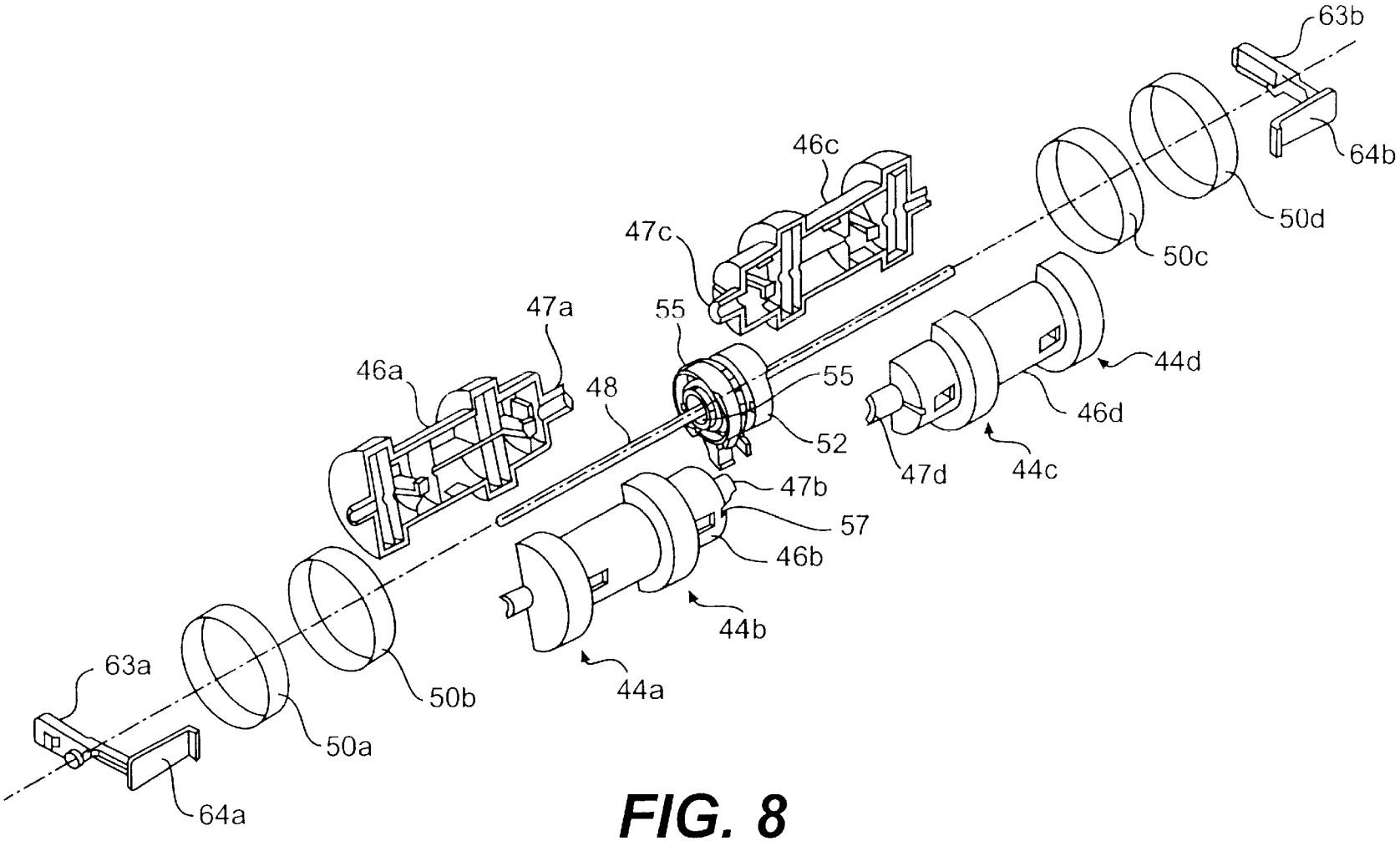
FIG. 8 is an exploded perspective view of a mechanism for rotating the reserve roll in the housing.
Figure 9:
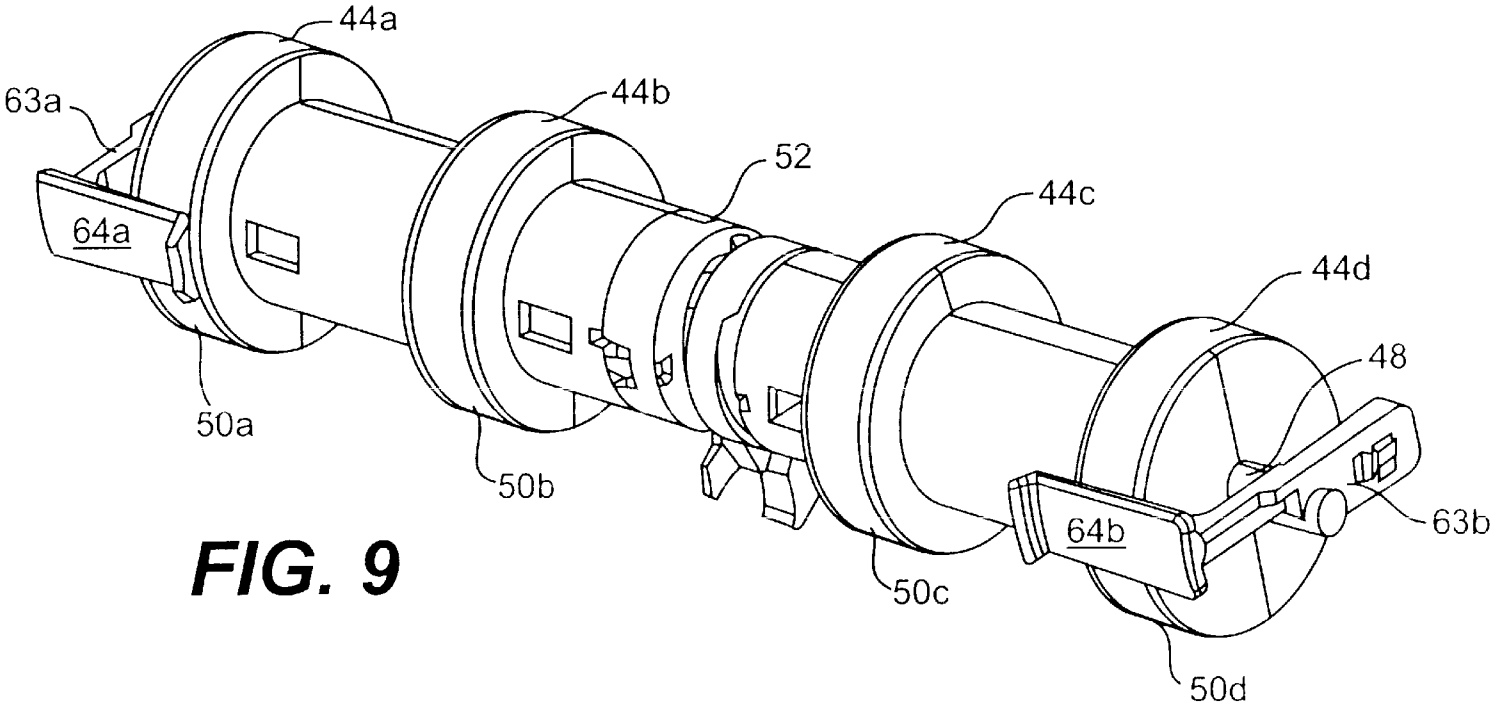
FIG. 9 is a perspective view of the rotating mechanism of FIG. 8.
Figure 10:
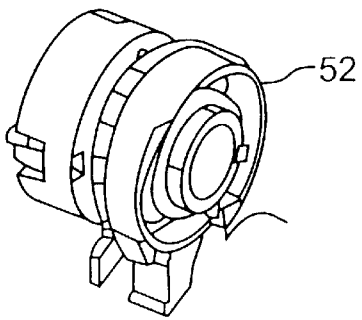
FIG. 10 is a perspective view of a one way clutch mechanism shown in FIGS. 8 and 9.

As shown in FIGS. 3*a*, 4, and 7, the dispensing rollers 44*a*, 44*b*, 44*c*, and 44*d* are mounted for rotation in the housing 12 between the dispensing outlet 38 and the section of the housing 12 for accommodating the reserve roll of material R. Preferably, the dispensing rollers 44*a*–44*d* are limited to only those rollers that rotate about the same rotational axis. However, additional rollers rotating about a different rotational axis are also possible. As shown in FIG. 8, the dispensing rollers 44*a* and 44*b* are formed by joining two half sections 46*a* and 46*b* together around a shaft 48, and the dispensing rollers 44*c* and 44*d* are formed by joining two half sections 46*c* and 46*d* together around the shaft 48. End portions 47*a* and 47*b* of half sections 46*a* and 46*b* are coupled to end portions 47*c* and 47*d* of half sections 46*c* and 46*d* so that the rollers 44*a*–44*d* rotate together. L-shaped bearing clips 63*a* and 63*b*, shown in FIGS. 8 and 9, are provided at opposite ends of the shaft 48 to mount the shaft 48 for rotation in the rear casing 16.

The circumferential surfaces of the rollers 44*a*, 44*b*, 44*c*, and 44*d* include respective friction bands 50*a*, 50*b*, 50*c*, and 50*d* made of a relatively high friction material, such as an elastomeric rubber material. The friction bands 50*a*, 50*b*, 50*c*, and 50*d* reduce slippage between the rollers 44*a*, 44*b*, 44*c*, and 44*d* and sheet material contacting the rollers 44*a*, 44*b*, 44*c*, and 44*d* during dispensing, as described below. Guides 64*a* and 64*b* located on a front portion of the L-shaped bearing clips 63*a* and 63*b* are spaced respectively from the outer circumferential surfaces of the rollers 44*a* and 44*d* to guide an end portion of sheet material from the reserve roll R prior to dispensing of the reserve sheet material, as described below.

Figure 11:
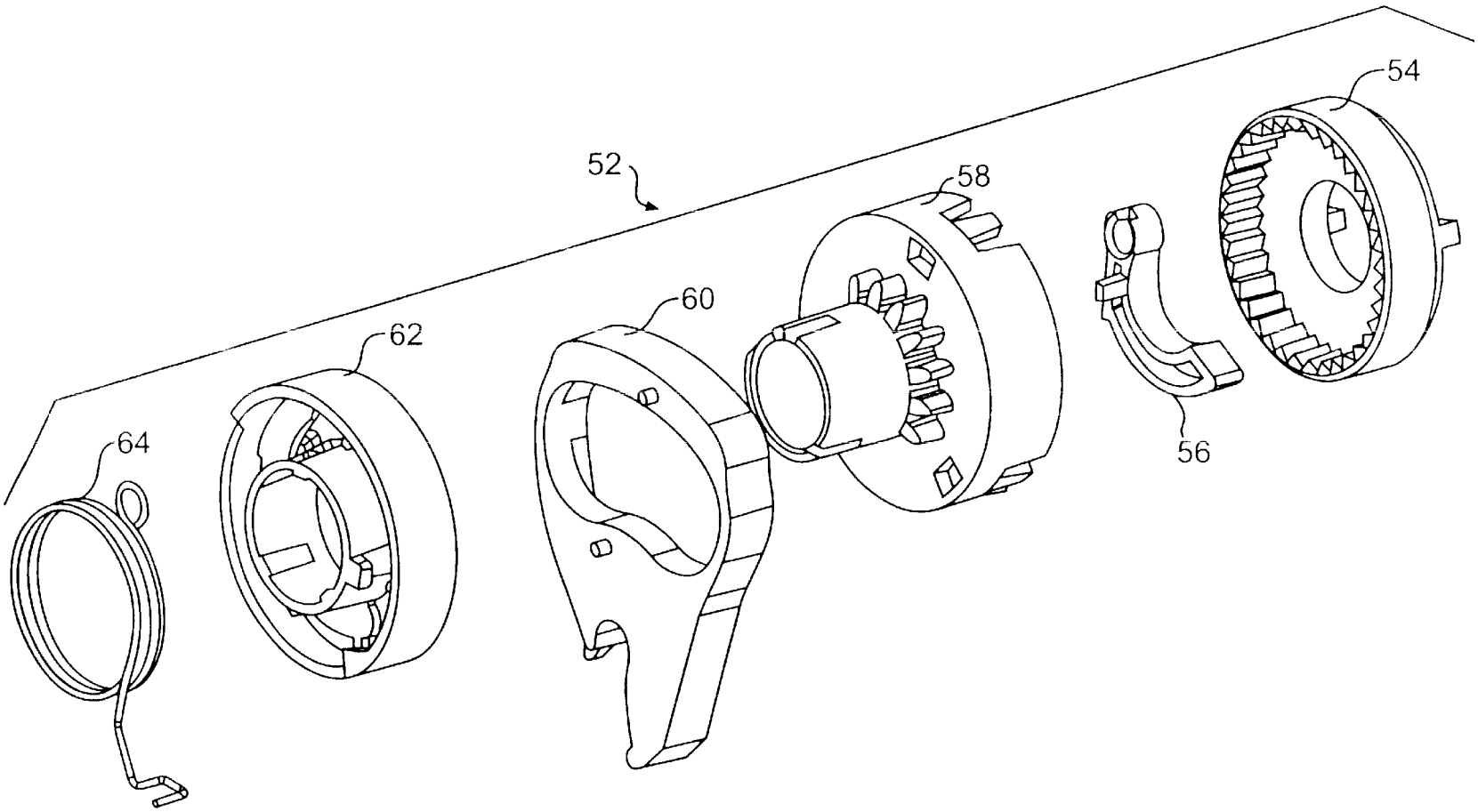
FIGS. 11 and 12 are exploded perspective views of the one way clutch mechanism shown in FIGS. 8–10.
Figure 12:
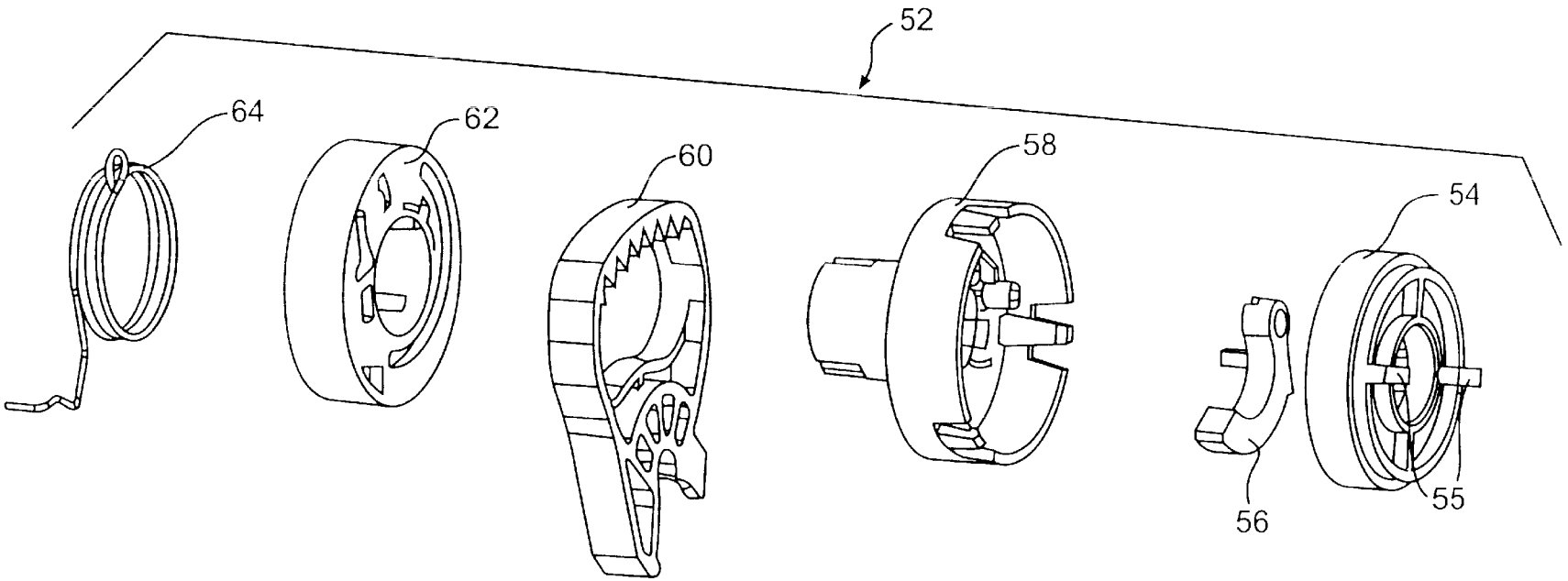

A one-way clutch assembly 52, shown in FIGS. 8–12, is located on the shaft 48 and on the end portions 47*a*–47*d*, shown in FIG. 8, between the middle dispensing rollers 44*b* and 44*c* to allow for rotation of the shaft 48 and rollers 44*a*–44*d* in a single rotational direction by actuating the lever 66 shown in FIGS. 1, 3*a*, 3*b*, and 4–7. The clutch assembly 52 also allows the rollers 44*a*–44*d* and shaft 48 to rotate independent of the movement of the lever 66. Locating the clutch assembly 52 between rollers 44*b* and 44*c* minimizes torsion and bending deflection of the shaft 48. As shown in FIGS. 11 and 12, the clutch assembly 52 preferably includes a drive gear 54, pawl 56, sprocket 58, driver 60, spring housing 62, and return spring 64. However, other clutch configurations are possible.

The lever 66, shown in FIGS. 1, 3*a*, 3*b*, and 4–7, is pivotally coupled to the lower portion of the rear casing 16 so that the lever 66 may be pressed inward toward the rear casing 16, as shown in FIG. 5, to cause the clutch assembly 52 to rotate the dispensing rollers 44*a*–44*d* and thereby dispense sheet material from the dispensing outlet 38. Pressing the lever 66 inwardly urges the lever 66 against the driver 60, shown in FIGS. 11 and 12, to pivot the driver 60. When the driver 60 pivots, teeth on the driver 60 engage teeth on the sprocket 58, and the driver 60 rotates the sprocket 58. Rotation of the sprocket 58 pivots the pawl 56 in the sprocket 58 to thereby place the pawl 56 in rotational driving engagement with the drive gear 54. The drive gear 54 includes radial projections 55, shown in FIGS. 8 and 12, placed in engagement with corresponding radial slots 57 (one of the slots 57 is shown in FIG. 8) formed in half sections 46*a* and 46*b* shown in FIG. 8. Because the end portions 47*a*–47*d* shown in FIG. 8 are coupled together, the rotation of the engaged sprocket 58 and drive gear 54 transmit rotational motion to the rollers 44*a*–44*d*. The sprocket 58 is coupled to the spring housing 62 so that the rotation of the sprocket 58 winds the return spring 64, and the return spring 64 biases and returns the lever 66 to its original position shown in FIGS. 1, 3*a*, 4, and 7.

Because the dispensing apparatus 10 normally allows for dispensing of sheet material by pulling an end portion of the sheet material, the lever 66 is preferably used as a secondary feeding mechanism only. In other words, the lever 66 is preferably used to dispense sheet material only when the sheet material does not extend from the dispensing outlet 38 or when the end portion of sheet material extending from the outlet 38 is too short to be grasped by a user. For example, each depression of the lever 66 rotates the rollers 44*a*–44*d* to advance the sheet material about one inch.

The lever 66 is pivotally coupled to the housing 12 below the rollers 44*a*–44*d* and extends behind the dispensing outlet 38 to define a rear edge of the dispensing outlet 38. As sheet material is dispensed from the outlet 38, the sheet material passes substantially over the lever 66 and covers the lever 66. This location of the lever 66 helps to limit user contact with the lever 66 when the sheet material is pulled from the opening 38. Because the lever 66 is normally hidden by the tail of sheet material, a user will normally remove sheet material from the apparatus 10 by pulling the end portion of the sheet material rather than actuating the lever 66.

As shown in FIG. 1, a pair of protuberances 68*a* and 68*b* extend outward from the front surface of the lever 66. The protuberances 68*a* and 68*b* each have a concave surface and are tapered from a respective side edge of the lever 66 toward a middle portion of the lever 66. The protuberances 68*a* and 68*b* are also tapered from a lower portion of the protuberances 68*a* and 68*b* toward the outlet 38. The protuberances 68*a* and 68*b* guide the sheet material outwardly away from the lever 66 as the sheet material passes through the outlet 38 to make the end portion of sheet material easier to grasp. In addition, the protuberances 68*a* and 68*b* limit pinching of the sheet material between the lever 66 and the front cover 14 when the lever 66 is depressed. Pressing the lever 66 forms a gap between the lever 66 and the edges of the front cover 14 defining the outlet 38. The protuberances 68*a* and 68*b* push the sheet material out away from the gap to prevent sheet material from passing in the gap.

Figure 6:
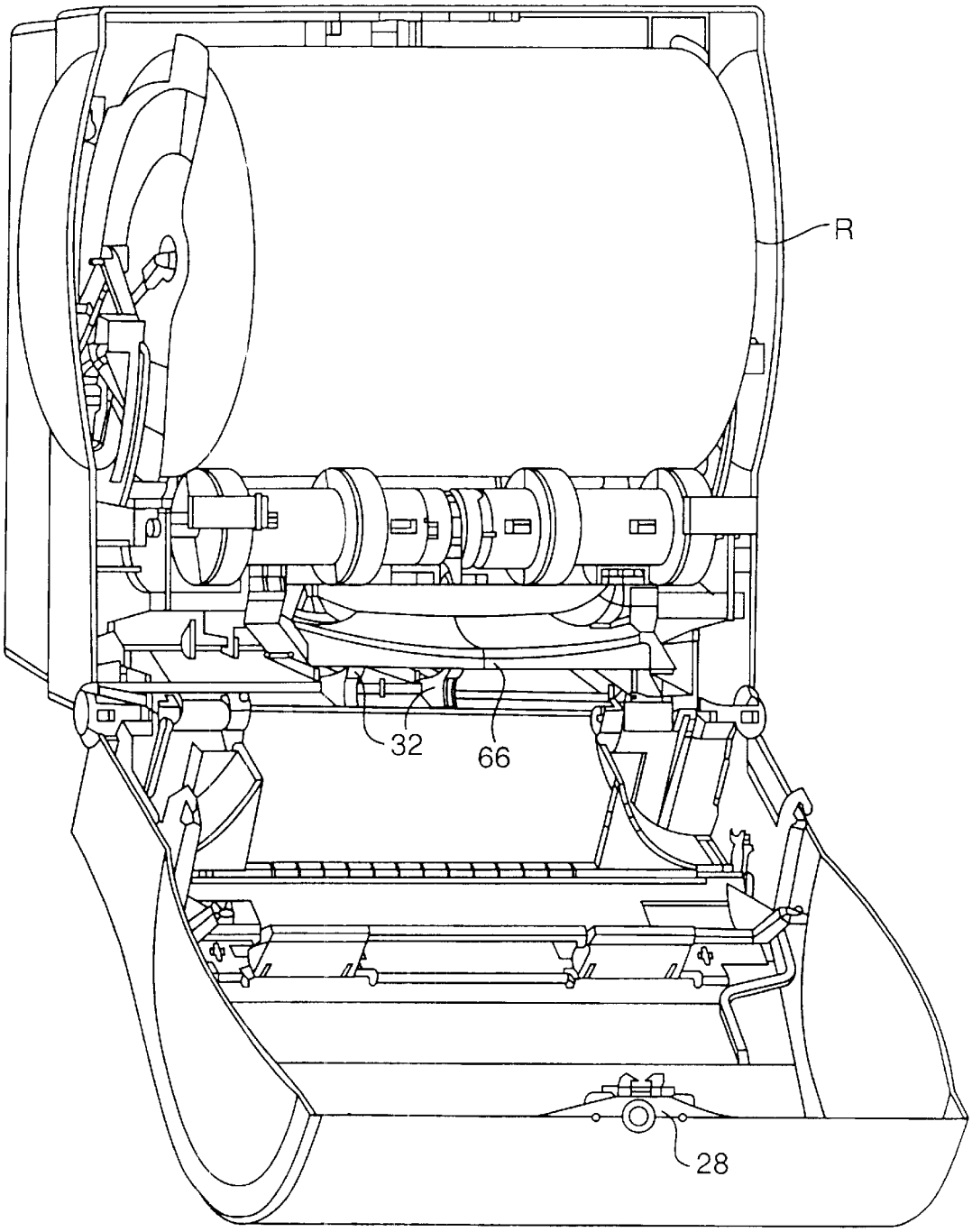
FIG. 6 is a view similar to FIGS. 4 and 5 showing a cam pressed toward a bottom of the housing and the sheet advancing lever pivoted away from the rear of the housing to allow a core of a stub roll to be removed from the housing interior while the reserve roll is in the housing.

As shown in FIGS. 3*a* and 6, the lever 66 extends in front of the portion of rear casing 16 for accommodating the stub roll S. Preferably, the pivotal coupling of the lever 66 allows the lever 66 to be pivoted upwards away from the rear casing 16, as shown in FIG. 6. This movement of the lever 66 allows access to the stub roll in the rear casing 16.

The outer circumferential surfaces of the dispensing rollers 44*a*–44*d* shown in FIGS. 3*a*, 4, and 7 provide a nipping surface. As shown in FIGS. 16–20, a nipping element 70 cooperates with these outer surfaces of the dispensing rollers 44*a*–44*d* to form a nip (i.e., restricted pathway) therebetween for passage of the sheet material before the sheet material passes through the outlet 38.

As described below and shown in FIGS. 3*a*, 4–7, and 13–15, the nipping element 70 is a curved nipping plate pivotally coupled to the front cover 14 of the housing 12 so that the nipping element 70 pivots between different positions depending upon whether sheet material is being dispensed primarily from the stub roll S or the reserve roll R. In particular, the nipping element 70 pivots between a first position, shown in FIGS. 18 and 19, and a second position, shown in FIGS. 16, 17, and 20. In the first position, shown in FIGS. 18 and 19, an upper portion of the nipping element 70 is spaced from the rollers 44*a*–44*d*, and a lower portion of the nipping element 70 and the outer nipping surfaces of the rollers 44*a*–44*d* form a nip for an end portion of sheet material from the stub roll S. In the second position, shown in FIGS. 16, 17, and 20, the upper and lower portions of the nipping element 70 and the outer nipping surfaces of the rollers 44*a*–44*d* form a nip for an end portion of sheet material from the reserve roll R. When sheet material is initially dispensed from the reserve roll R, as shown in FIG. 20, the nipping element 70 is in the second position, and the upper and lower portions of the nipping element 70 and the rollers 44*a*–44*d* form a nip for both an end portion of sheet material from the reserve roll R and an end portion of sheet material of the stub roll S.

Although the nip is preferably formed between the nipping element 70 and each of the outer surfaces of the rollers 44*a*–44*d*, the nip could be formed between many different structural elements. For example, as shown schematically in FIG. 26, the nip could be formed between one or more of the rollers 44*a*–44*d* and one or more additional rollers 45 mating with the rollers 44*a*–44*d*, or the nip could be formed between a surface of the housing 12 and one or more of the rollers 44*a*–44*d*. Alternatively, the nip could be formed between the nipping element 70 and a single roller (not shown) or any other number of rollers.

Figure 13:
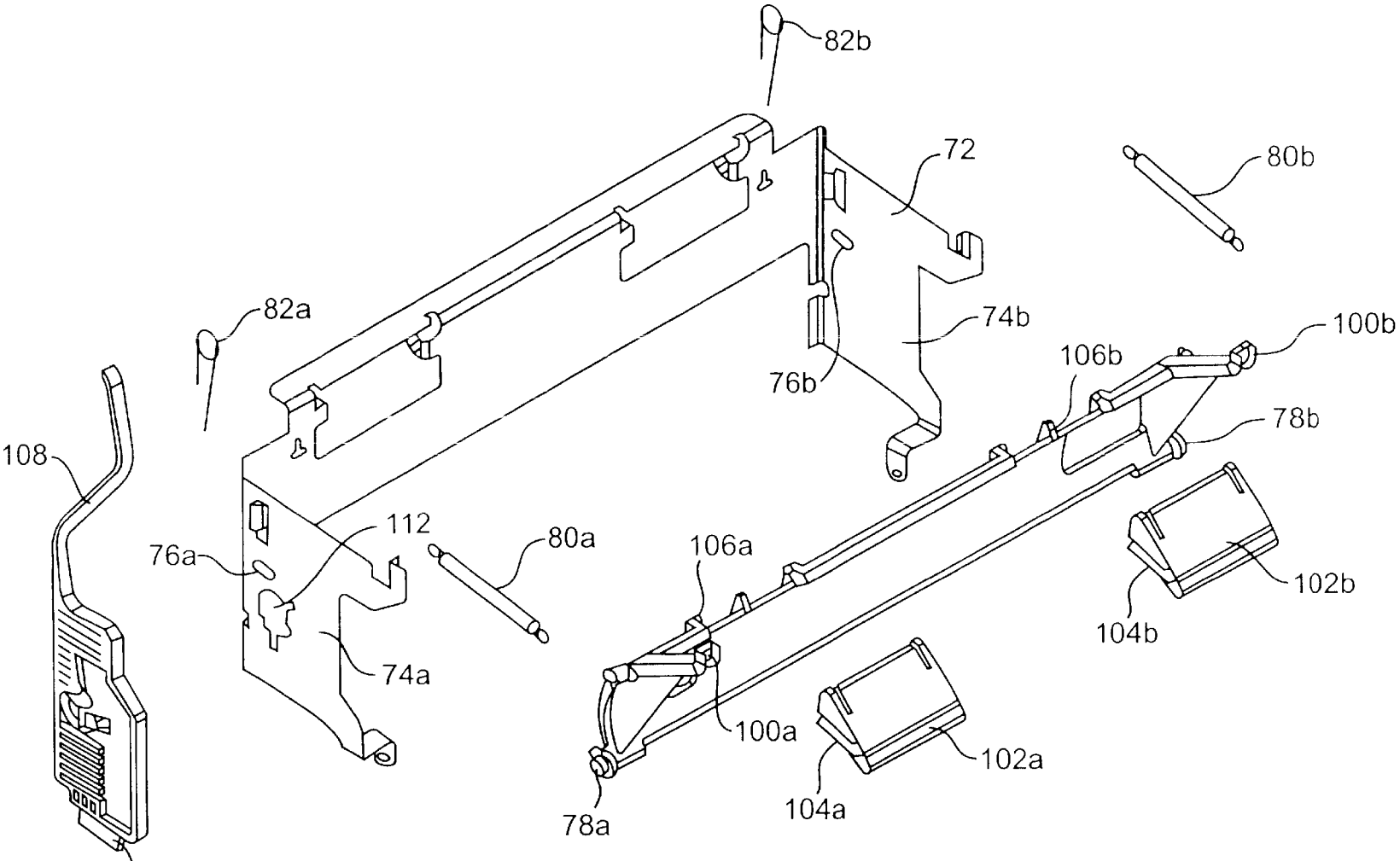
FIG. 13 is an exploded perspective view of a transfer mechanism and reserve roll sensor for the apparatus.

As shown in FIGS. 3*a*, 4,14, and 15, a mounting plate 72 is attached to the inside of the front cover 14. As shown in FIG. 13, the mounting plate 72 includes opposite side portions 74*a* and 74*b* having respective elongated slots 76*a* and 76*b*. As is also shown in FIG. 13, the nipping element 70 includes pivoting projection pins 78*a* and 78*b* extending in opposite directions from a lower portion of the nipping element 70. The nipping element 70 is coupled to the mounting plate 72, as shown in FIGS. 14 and 15, so that the projection pins 78*a* and 78*b* are rotationally and axially movable in the slots 76*a* and 76*b*, respectively, to allow for both pivotal movement of the nipping element 70 and axial movement of the nipping element 70 toward and away from the dispensing rollers 44*a*–44*d* shown in FIGS. 3*a*, 4, and 7.

The pivotal movement of the nipping element 70 allows the nipping element 70 to be moved between the first and second pivot positions shown in FIGS. 18 and 19 and FIGS. 16, 17, and 20, respectively. The axial and rotational movement of the nipping element 70 allows axial and rotational biasing (described below) of the nipping element 70 toward the dispensing rollers 44*a*–44*d* to form the nip.

As shown in FIGS. 13 and 14, a first pair of biasing elements 80*a* and 80*b* are connected between a top portion of the nipping element 70 and a portion of the mounting plate 72 to bias the nipping element 70 rotationally toward the dispensing rollers 44*a*–44*d* shown in FIGS. 3*a*, 4, and 7. In addition, a second pair of biasing elements 82*a* and 82*b* shown in FIG. 13 are provided about the projection pins 78*a* and 78*b* to bias the nipping element 70 axially toward the dispensing rollers 44*a*–44*d*. Preferably, the first pair of biasing elements 80*a* and 80*b* are axial coil springs and the second pair of biasing elements 82*a* and 82*b* are torsion springs.

Figure 23:
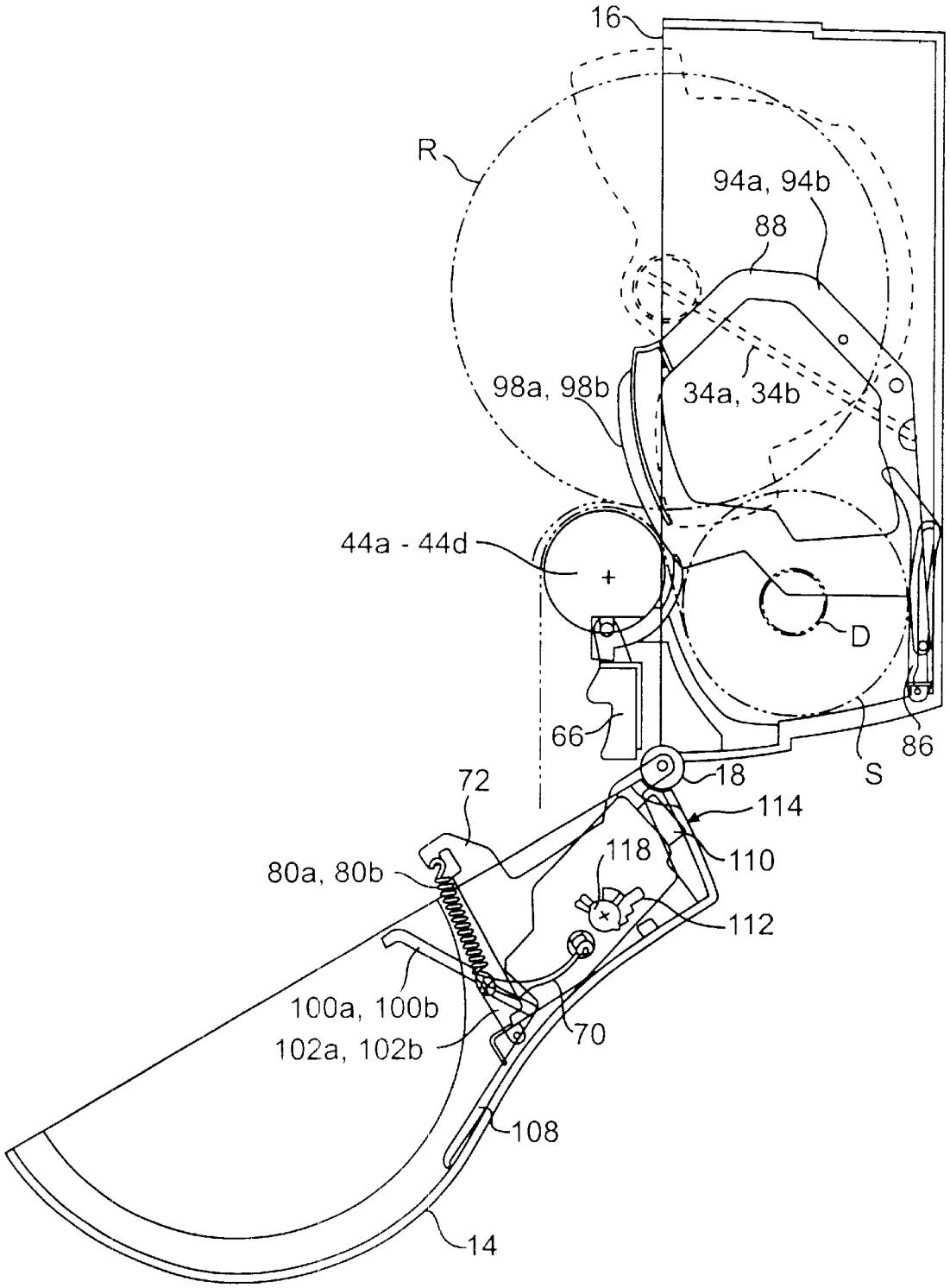
FIG. 23 is a partially schematic side view of the interior of the housing with the front cover opened to place the indicator in a nonindication position.

As shown in FIGS. 16–20, the biasing elements 80*a*, 80*b* and 82*a*, 82*b* maintain at least a portion of the nipping element 70 biased toward the dispensing rollers 44*a*–44*d* to form a nip between the nipping element 70 and the dispensing rollers 44*a*–44*d* when the front cover 14 is closed. Because the rollers 44*a*–44*d* are mounted in the rear casing 16 and the nipping element 70 is mounted in the front cover 14, the nipping element 70 moves away from the rollers 44*a*–44*d* during opening of the front cover 14, as shown in FIGS. 3*a*, 4, and 23. In other words, the opening of the front cover 14 "opens" (eliminates) the nip formed between the nipping element 70 and rollers 44*a*–44*d*. This opening of the nip permits sheet material to be positioned on an outer surface of the rollers 44*a*–44*d*, and this sheet material is eventually placed in the nip automatically after the front cover 14 is closed, as explained below. Although the preferred embodiment shown in the drawings includes the nipping element 70 mounted in the front cover 14 and the rollers 44*a*–44*d* mounted in the rear casing 16, other mounting configurations are possible.

The inventors have discovered that certain characteristics of the sheet material and the apparatus 10 improve reliability of dispensing and/or separation of individual material sheets. As described below, these characteristics include the relationship between the width A of the outlet 38 (see FIGS. 4 and 24), the overall sheet material width B, a distance C shown in FIG. 24, and angles X and Y.

When the front cover 14 is closed, at least an inner surface of a lower edge 84, shown in FIG. 4, of the nipping element 70 and an outer surface of the rollers 44*a*–44*d* form the nip. The exit end of the nip (the downstream portion of the nip in the direction of travel of the sheet material) is preferably spaced the same distance away from the edge 43*a* of the horizontal planar wall 42*a* and the edge 43*a* of the horizontal planar wall 42*b* partially defining the dispensing outlet 38. As shown schematically in FIGS. 16 and 24, an imaginary line E is defined as a line extending along the exit of the nip (the downstream end of the nip in the direction of travel of the sheet material). Points H and J shown in FIG. 24 are points of contact between sheet material dispensed through outlet 38 and the respective edges 43*a* and 43*b* (see FIG. 4) of wall surfaces 42*a* and 42*b* defining the outlet 38. Points H and J are preferably spaced a distance C of from about 0.1 inch to about 3 inches, more preferably from about 0.8 inch to about 1.1 inches, and most preferably from about 0.9 inch to about 1 inch, to the respective closest point on line E. Points F and G shown in FIG. 24 are defined by the outermost (in the direction of the width B) lateral end of the nip that contains the sheet material along line E. Angles X and Y are defined as angles formed between line E and the lines connecting points G and J and points F and H, respectively.

In accordance with the invention, the angles X and Y are preferably from about 26° to about 39°, more preferably from about 29° to about 36°, and most preferably from about 32° to about 33°.

A sensor is provided in the dispensing apparatus 10 for sensing the diameter of the stub roll S and for controlling the pivoting of the nipping element 70 in response to sensing a predetermined diameter for the stub roll S. The sensor preferably includes a contact element 86 and cam 88 pivotally mounted in the rear casing 16, as shown in FIGS. 3*b*, 7, and 16–23. The contact element 86 is pivotally connected to the bottom rear interior surface of the rear casing 16. As sheet material is dispensed from a stub roll S in the rear casing 16, the contact element 86 pivots counterclockwise, as shown in the views of FIGS. 16–23, from a first position shown in FIGS. 18 and 23 to a second position shown in FIGS. 16, 17, 21, and 22. During this pivoting, a lower contacting surface of the contact element 86 contacts the outer circumferential surface of the stub roll S.

The cam 88 is pivotally connected to a rear wall of the rear casing 14. As shown in FIGS. 16–22, a projection pin 92 extends from the cam 88 into an elongated slot 90 in the contact element 86 to couple pivotal movement of the contact element 86 and the cam 88. As the sheet material is dispensed from the stub roll S, the cam 88 pivots clockwise, as shown in the views of FIGS. 16–22, from a first position shown in FIG. 18 to a second position shown in FIGS. 16,17, and 20–22. During this pivoting, the projection pin 92 moves along the length of the slot 90.

Preferably, one or more biasing elements 116*a* and 116*b* (see FIG. 3*b*), such as torsion springs, are provided at the pivot point of the cam 88 to bias the cam 88 rotationally in the clockwise direction as shown in FIGS. 16–22. Because the movement of the cam 88 and contact element 86 are linked to one another, the biasing elements 116*a* and 116*b* also bias the contact element 86 toward the stub roll S in the rear housing 16. This ensures that the lower contacting surface of the contact element 86 remains in contact with the stub roll S to track the diameter of the stub roll S as sheet material is dispensed therefrom. The biasing of the contact element 86 against the stub roll S also provides a force that maintains the stub roll S between the contact element 86 and ribs 32, shown in FIGS. 6 and 7, in the rear casing 16 without allowing the stub roll S to translate upwards toward the dispensing rollers 44*a*–44*d* throughout the dispensing of sheet material from the stub roll S. In addition, the biasing of the contact element 86 against the stub roll S limits free rotation of the stub roll S throughout the dispensing from the stub roll S. To limit free rotation of the stub roll S even more, the contact element 86 also may include ribs (not shown) to increase friction between the stub roll S and the contact element 86.

As shown in FIGS. 3*a*, 3*b*, and 7, the cam 88 includes a pair of arms 94*a* and 94*b* spaced apart so that the tensioning elements 36*a* and 36*b* are positioned therebetween. The arms 94*a* and 94*b* include tabs 96*a* and 96*b*, respectively. When the front cover 14 is open, the tabs 96*a* and 96*b* may be pressed by a user to pivot the cam 88 and contact element 86 away from the stub roll compartment of the rear housing 16, as shown in FIGS. 6 and 7. This allows for insertion of a stub roll into the stub roll compartment of the rear casing 16. In addition, the movement of the cam 88 and contact element 86 allows for removal of a core D of a stub roll (see FIGS. 16 and 17) after pivoting the lever 66 away from the rear casing 16, as shown in FIG. 6.

As shown in FIGS. 3*a*, 3*b*, and 7, cam surfaces 98*a* and 98*b* are provided on the front of the arms 94*a* and 94*b* to control pivoting of the nipping element 70. Cam followers 100*a* and 100*b*, shown in FIGS. 4 and 13–15, extend from opposite ends of the nipping element 70 and contact the cam surfaces 98*a* and 98*b* during dispensing of sheet material from the stub roll S. To maintain the contact between the cam followers 100*a* and 100*b* and the cam surfaces 98*a* and 98*b*, the biasing elements 80*a* and 80*b* and 82*a* and 82*b*, shown in FIG. 13, bias the cam followers 100*a* and 100*b* toward the cam surfaces 98*a* and 98*b*.

Figure 18:
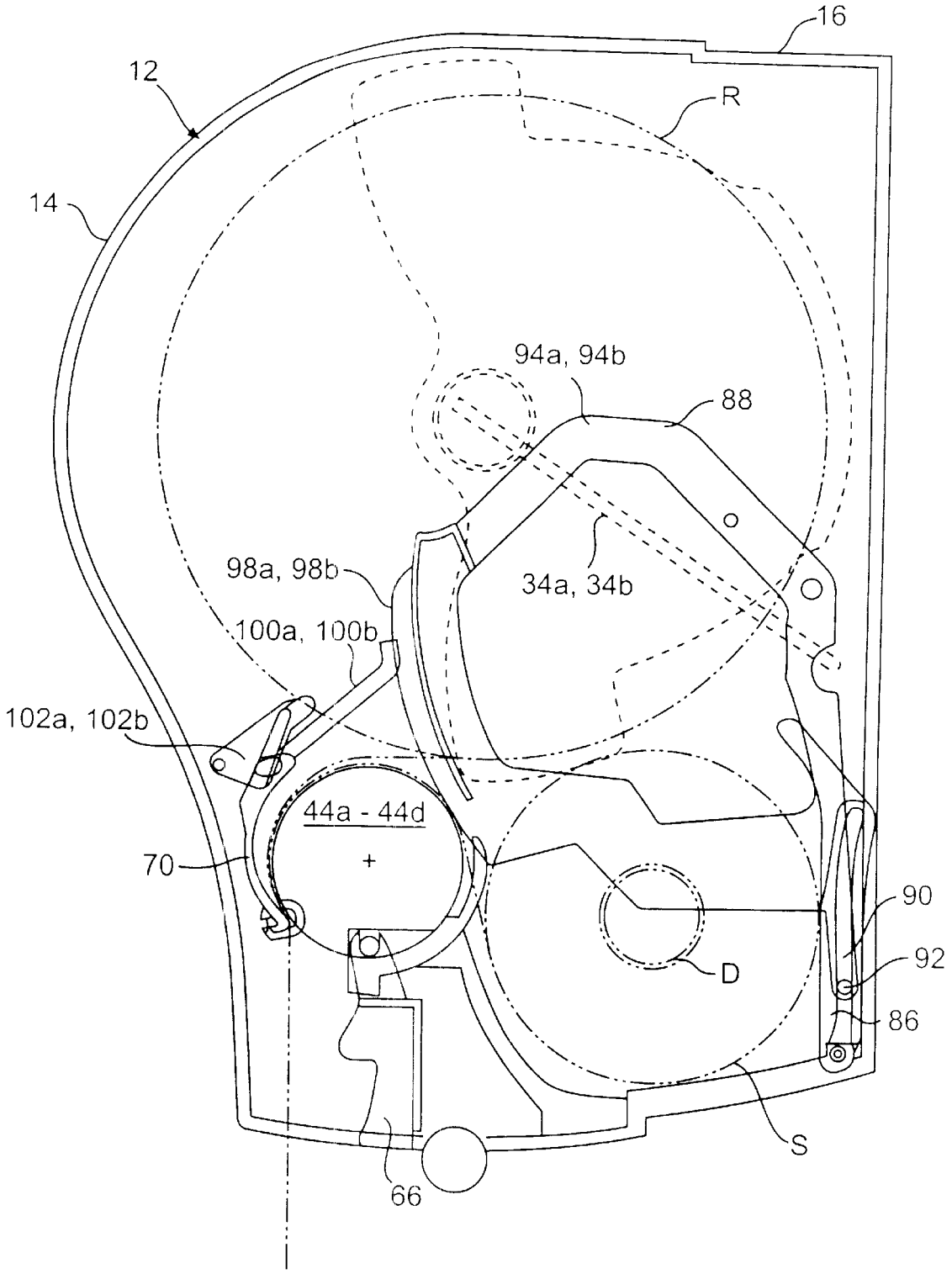
FIG. 18 is a view, similar to FIG. 16, showing dispensing from a stub roll after the stub roll is placed in the stub roll compartment and a new reserve roll is loaded in the housing.
Figure 19:
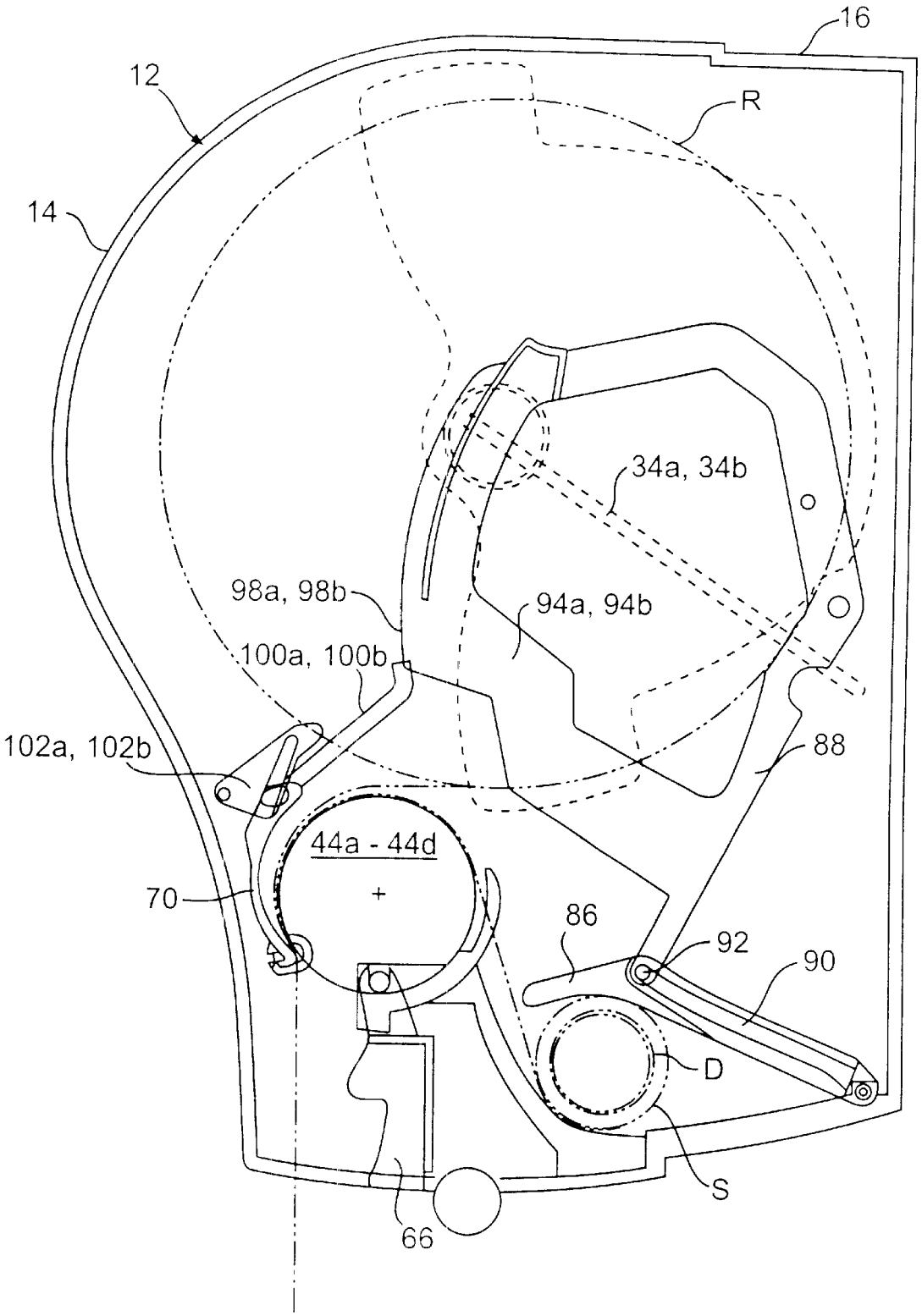
FIG. 19 is a view, similar to FIG. 16, showing dispensing from the stub roll just before transfer to the reserve roll.
Figure 20:
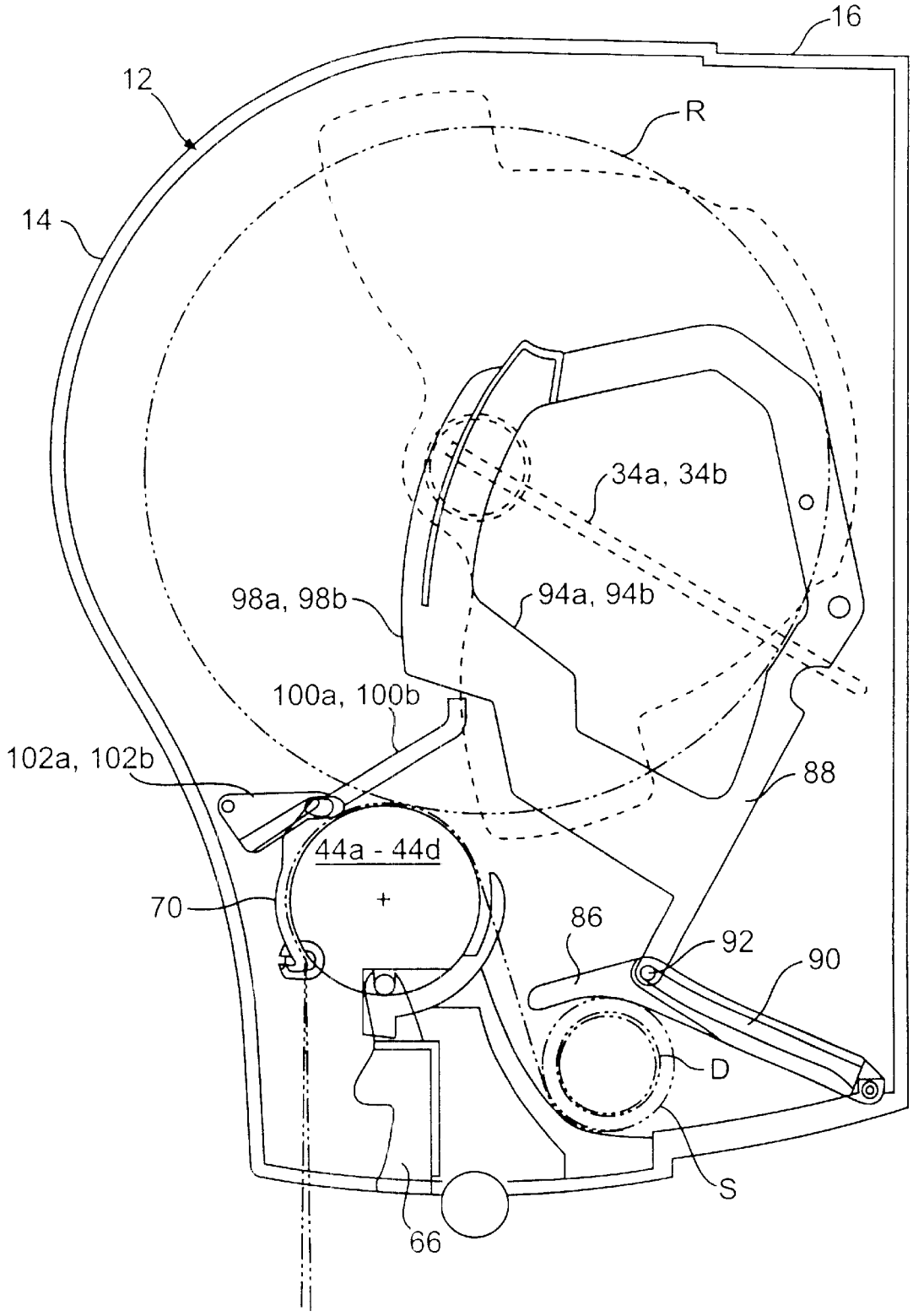
FIG. 20 is a view, similar to FIG. 16, showing dispensing from both the stub roll and the reserve roll after transfer to the reserve roll.

As shown in FIGS. 18 and 19, when the sheet material is dispensed from the stub roll S, the cam surfaces 98*a* and 98*b* slide with respect to the cam followers 100*a* and 100*b* away from the rollers 44*a*–44*d* while the arms 94*a* and 94*b* pivot. When almost all of the sheet material is removed from the stub roll S, as shown in FIG. 20, the cam surfaces 98*a* and 98*b* slide past the cam followers 100*a* and 100*b*. This places the cam followers 100*a* and 100*b* out of engagement with the cam surfaces 98*a* and 98*b* and thereby allows the biasing elements 80*a* and 80*b*, shown in FIG. 13, to bias the nipping element 70 pivotally toward the dispensing rollers 44*a*–44*d*, as shown in FIGS. 16 and 17.

Prior to pivoting of the nipping element 70, the guides 64*a* and 64*b* extending from the L-shaped bearing clips 63*a* and 63*b*, shown in FIGS. 3*b*, 8, and 9, align an end portion of sheet material from the reserve roll between the nipping element 70 and stub roll sheet material contacting the dispensing rollers 44*a*–44*d*. Preferably, the cam surfaces 98*a* and 98*b*, shown in FIGS. 3*a*, 3*b*, and 7, are shaped so that the pivoting of the nipping element 70 toward the rollers 44*a*–44*d* occurs just prior to when all of the sheet material is removed from the stub roll S. When the nipping element 70 pivots toward the rollers 44*a*–44*d* into the position shown in FIG. 20, the upper portion of the nipping element 70 places the end portion of sheet material from the reserve roll R in a nip formed between the nipping element and rollers 44*a*–44*d*. Continued dispensing of material from the stub roll S causes rotation of the rollers 44*a*–44*d* to also dispense the sheet material of the reserve roll R from the outlet 38, as shown in FIG. 20.

The dispensing apparatus 10 also preferably includes structure for limiting contact of the reserve roll R with the outer surface of the rollers 44*a*–44*d* and stub roll sheet material on the rollers 44*a*–44*d* during dispensing of sheet material from the stub roll S, as shown in FIGS. 18 and 19. As shown in FIGS. 3*a* and 13–15, isolating elements 102*a* and 102*b* are pivotally coupled to the mounting plate 72 attached to the inside of the front cover 14. The isolating elements 102*a* and 102*b* include respective side slots 104*a* and 104*b*, shown in FIG. 13, for controlling pivoting of the isolating elements 102*a* and 102*b*.

Projection pins 106*a* and 106*b* extending from a top portion of nipping element 70 move in the slots 104*a* and 104*b*, respectively, during pivoting of the nipping element 70 to control movement of the isolating elements 102*a* and 102*b*. The slots 104*a* and 104*b* are shaped so that the top end portions of the isolating elements 102*a* and 102*b* move upwards in the housing 12 above a top surface of the nipping element 70 when the nipping element 70 pivots away from the rollers 44*a*–44*d*, as shown in FIGS. 18 and 19. In this position, the isolating elements 102*a* and 102*b* lift the reserve roll R above the outer surface of the dispensing rollers 44*a*–44*d* so that the reserve roll R does not rotate along with dispensing rollers 44*a*–44*d* during dispensing of the stub roll sheet material.

When the nipping element 70 pivots toward the dispensing rollers 44*a*–44*d*, as shown in FIG. 20, the projection pins

106*a* and 106*b*, shown in FIG. 13, slide in the slots 104*a* and 104*b*, and the top end portions of the isolating elements 102*a* and 102*b* move downwards in the housing 12 approximately level with a top surface of the nipping element 70. In this position, shown in FIGS. 16, 17, and 20, the reserve roll R is placed on stub roll sheet material covering the dispensing rollers 44*a*–44*d* so that the reserve roll R and rollers 44*a*–44*d* rotate together. Because the isolating elements 102*a* and 102*b* extend and retract in response to pivoting of the nipping element 70, the pivotal movement of the contact element 86 and cam 88 and movement of the camming surfaces 98*a* and 98*b* control the movement of the isolating elements 102*a* and 102*b*.

During placement of the reserve roll R on the rollers 44*a*–44*d*, the guides 37*a* and 37*b*, shown in FIGS. 3*a*, 3*b*, and 7, guide the sheet material of the reserve roll R to limit lateral sheet material tracking in the dispenser 10. In addition, the friction bands 50*a*, 50*b*, 50*c*, and 50*d*, shown in FIGS. 8 and 9, on respective rollers 44*a*, 44*b*, 44*c*, and 44*d* increase friction between the reserve roll R and the rollers 44*a*–44*d*.

Figure 21:
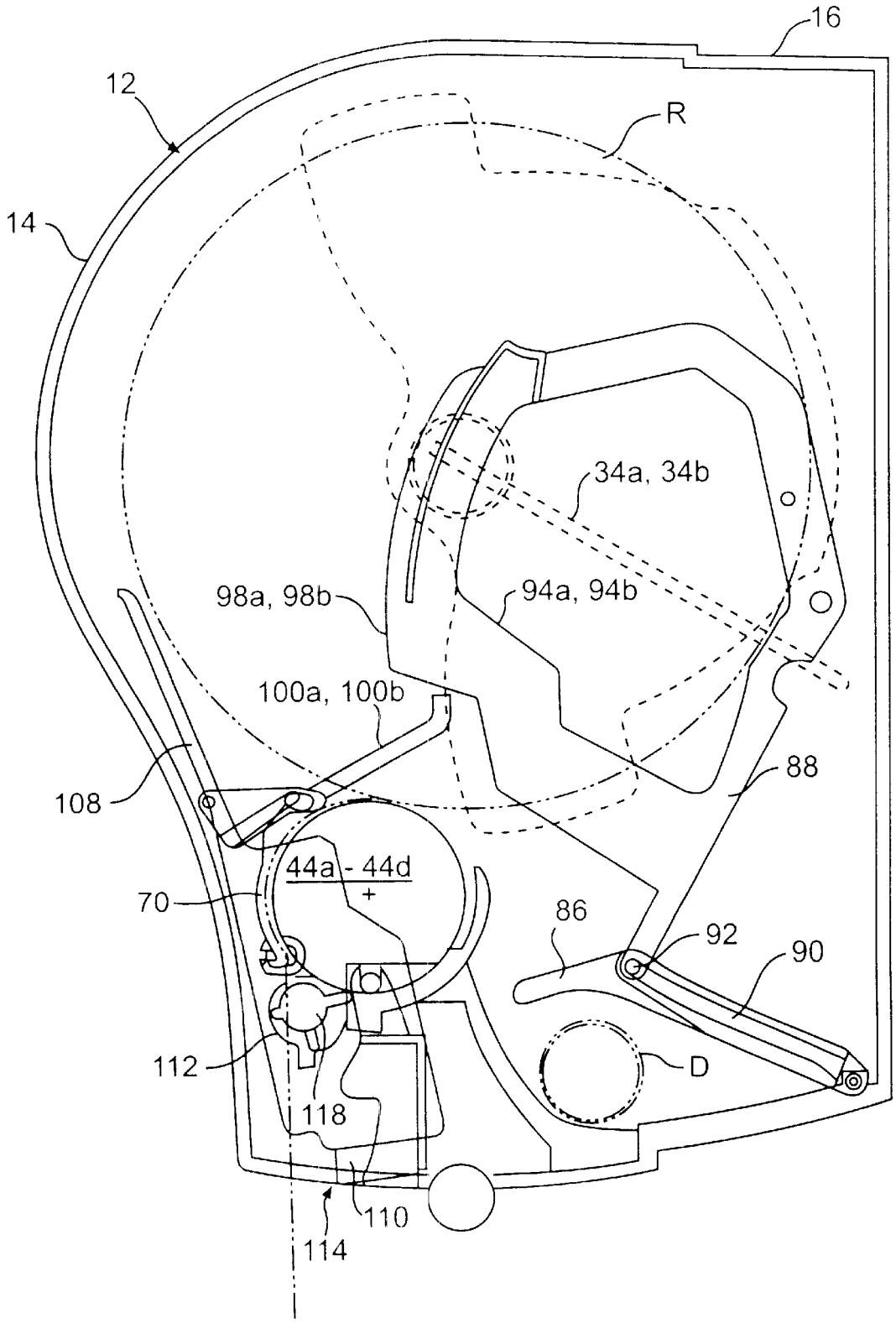
FIG. 21 is a view, similar to FIG. 16, showing the reserve roll sensor and an indicator located in the housing during initial dispensing from the reserve roll.
Figure 22:
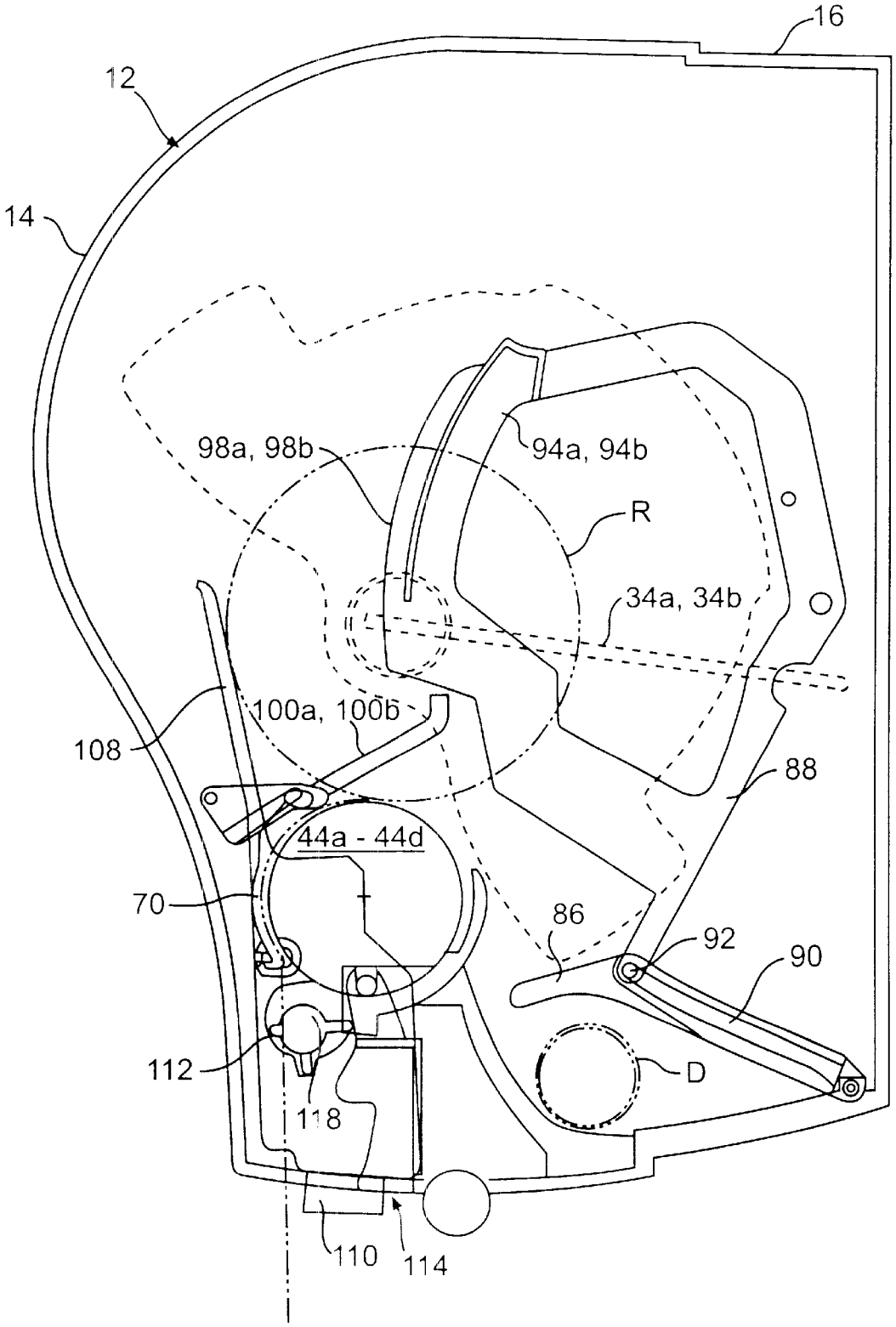
FIG. 22 is a view, similar to FIG. 17, showing the indicator extending through an opening in the housing when the reserve roll is a predetermined size sufficient to place the reserve roll in the stub roll compartment.

As shown in FIGS. 13, 14, and 21–23, a movable reserve roll diameter sensor 108 and indicator 110 are provided for respectively monitoring the diameter of the reserve roll R and providing an indication when the reserve roll R is a predetermined diameter. The indicator 110 extends from the roll diameter sensor 108 and includes a projection 118 (see FIGS. 21–23) placed in a slot 112 (see FIGS. 13 and 21–23) formed in the mounting plate 72 for controlling movement of the indicator 110. As shown in FIGS. 21–23, the roll diameter sensor 108 has a surface for contacting the reserve roll R during dispensing of sheet material from the reserve roll R. When sheet material is removed from the reserve roll R, the roll diameter sensor 108 pivots due to gravity toward the reserve roll R and thereby pivots the projection 118 in the slot 112.

As shown in FIGS. 3*a* and 4, a bottom portion of the front cover 14 includes an indicator opening 114. When the reserve roll R is a predetermined diameter, the indicator 110 and projection 118 pivot so that the slot 112 allows a portion of the indicator 110 to drop through the indicator opening 114, as shown in FIG. 22.

As shown in FIGS. 16–23, the interior section of the housing 12 for accommodating the stub roll S is smaller than the interior section of the housing 12 for accommodating the reserve roll R. Preferably, the slot 112, shown in FIGS. 13 and 21–23, is shaped so that the portion of the indicator 110 drops through the indicator opening 114 when the diameter of the reserve roll R is small enough to place the reserve roll R in the stub roll compartment of the housing 12. In other words, the indicator 110 provides a discrete, visual indication of when the reserve roll R will fit and can be placed in the stub roll compartment and a new reserve roll can be loaded in the housing 12. The indicator 110 differs from conventional sheet material dispensers including a display proportional to the diminishing diameter of a product roll, because these conventional displays do not indicate a definitive time when the reserve roll will fit in the stub roll compartment, but rather leave the decision about whether a new roll of material can be loaded up to the subjective discretion of an operator person. Thus, the present invention reduces problems associated with premature opening of the cabinet by inexperienced operators.

The indicator 110 extends from the indicator opening 114 until the front cover 14 is opened and a new reserve roll R is loaded in the housing 12. Opening the front cover 14 moves the indicator 110 in the housing 12 via the opening 114, as shown in FIG. 23, and resets the indicator 110 for sensing the diameter of the new reserve roll R.

Methods of dispensing sheet material from at least one roll of sheet material are discussed below with reference to FIGS. 1, 2, 3*a*, 3*b*, and 4–23. The roll of sheet material includes a plurality of individual sheets separated by perforation tear lines including frangible perforation bonds and perforations. Although the invention is described in connection with the structure shown in FIGS. 1, 2, 3*a*, 3*b*, and 4–23 and in connection with the dispensing of rolled sheet material having perforation tear lines including frangible perforation bonds and perforations, it should be understood that the invention in its broadest sense is not so limited.

To load the dispensing apparatus 10 initially with sheet material, an operator moves the front cover 14 to the open position, as shown in FIG. 3*a*, so that the nipping element 70 moves away from the rollers 44*a*–44*d* to open the nip. The operator then mounts a roll of sheet material R in the mounts 35*a* and 35*b* on the arms 34*a* and 34*b*, as shown in FIG. 4, and allows the roll of sheet material R to rest on the surface of the rollers 44*a*–44*d*. While the cover 14 is still in the open position, the operator extends a tail end portion of sheet material from the reserve roll R and passes this tail end portion along the surface of the rollers 44*a*–44*d*, between the rollers 44*a* and 44*d* and the guides 64*a* and 64*b*, and through the dispensing outlet 38.

Then, the operator pivots the front cover 14 to the closed position shown in FIGS. 1 and 2. When the front cover 14 is closed, upper and lower portions of the nipping element 70 form a nip for passage of the sheet material between the nipping element 70 and the outer nipping surface of the rollers 44*a*–44*d*, as shown in FIG. 16, and the biasing elements 80*a*, 80*b*, 82*a*, and 82*b*, shown in FIG. 13, bias the nipping element 70 toward the rollers 44*a*–44*d*. The nip, friction bands 50*a*, 50*b*, 50*c*, and 50*d* shown in FIGS. 8 and 9, and tensioning elements 36*a* and 36*b* shown in FIGS. 3*a*, 3*b*, and 7 apply frictional braking forces on the sheet material to limit free rotation of the sheet material roll R and to restrain lateral translation of the sheet material relative to the rollers 44*a*–44*d* during dispensing of the sheet material through the dispensing outlet 38.

When a user pulls the end portion of sheet material extending from the dispensing outlet 38, the roll of sheet material rotates and tension induced in the sheet material is concentrated at the edges of the sheet material by the narrowed dispensing outlet 38, initiating separation at the perforation tear line from one or both edges. Continued pulling of the end portion of sheet material propagates the perforation separation across the sheet from the edges toward the center to dispense a single sheet, as shown in FIG. 2. During pulling of the sheet material, the rollers 44*a*–44*d*, shown in FIGS. 3*a*, 4, and 7–9, and the sheet material roll R rotate in the housing 12.

If the end portion of sheet material does not extend a sufficient distance out from the dispensing outlet 38, a user may depress the lever 66, as shown in FIG. 5, while the front cover 14 is maintained in the closed position. Actuating the lever 66 rotates the rollers 44*a*–44*d* and thereby passes sheet material in the nip out from the dispensing outlet 38.

As the diameter of the roll R of sheet material is reduced, the roll diameter sensor 108 monitors the diameter of the roll R and, when the diameter of the roll R is small enough to place the roll R in the stub roll compartment of the rear casing 16, a portion of the indicator 110 extends from the housing 12, as shown in FIG. 22. This provides a visual indication of the need to place a new reserve roll in the housing 12.

To load a new reserve roll of sheet material in the apparatus 10, the operator pivots the front cover 14 to the open position shown in FIGS. 3*a* and 23. When the front cover 14 is opened, the indicator 110 moves in the housing 12 via the opening 114, as shown in FIG. 23, so that the indicator 110 and roll diameter sensor 108 are reset to the position shown in FIG. 21 upon loading of the new reserve roll and closing of the front cover 14.

Opening the front cover 14 also moves the nipping element 70 away from the rollers 44*a*–44*d* to remove the sheet material nip. If a core D, shown in FIGS. 16, 17, 21, and 22, of a previously expired stub roll is present in the stub roll compartment of the rear casing 16, one or both of the tabs 96*a* and 96*b*, shown in FIGS. 3*a*, 3*b*, and 7, are pressed to pivot the contact element 86 away from the core D, and the lever 66 is pivoted up and away from the rear casing 16, as shown in FIG. 6. The core D is then passed under the rollers 44*a*–44*d* to remove it from the rear casing 16.

To move the partially consumed reserve roll R to the stub roll compartment of the rear casing 16, the operator presses one or both of the tabs 96*a* and 96*b* shown in FIGS. 3*a*, 3*b*, and 7 to pivot the cam 88 and contact element 86 away from the stub roll compartment, as shown in FIGS. 6 and 7. The operator then removes the partially consumed reserve roll R shown in FIGS. 17 and 22 from the mounts 35*a* and 35*b* and moves this roll into the stub roll compartment of the rear casing 16 to act as a stub roll S, as shown in FIGS. 18 and 23. When the stub roll S is moved into the stub roll compartment, the end portion of sheet material extending from the stub roll S remains on the exterior surface of the rollers 44*a*–44*d* and continues to extend from the dispensing outlet 38. Releasing the pressure applied to the tabs 96*a* and 96*b* allows the biasing elements 116*a* and 116*b*, shown in FIG. 3*b*, to bias the contact element 86 against the outer surface of the stub roll S, as shown in FIGS. 18 and 23.

The operator then places a new reserve roll R in the mounts 35*a* and 35*b* and passes a relatively short end portion of sheet material from the reserve roll R between the guides 64*a* and 64*b* shown in FIGS. 3*a* and 4 and the end portion of stub roll sheet material passing on the outer surface of the rollers 44*a*–44*d*. When the front cover 14 is pivoted to the closed position, as shown in FIG. 18, the cam followers 100*a* and 100*b* contact the respective cam surfaces 98*a* and 98*b* on the arms 94*a* and 94*b*. This pivots the upper portion of the nipping element 70 away from the rollers 44*a*–44*b* to prevent nipping of the end portion of sheet material extending from the reserve roll R. The pivoted position of the nipping element 70, shown in FIG. 18, also extends the isolating elements 102*a* and 102*b* above a top surface of the nipping element 70. This causes the isolating elements 102*a* and 102*b* to lift the reserve roll R away from the outer surface of the rollers 44*a*–44*d* and thereby limits contact between the reserve roll R and the rollers 44*a*–44*d* and between the reserve roll R and stub roll sheet material on the rollers 44*a*–44*d*.

As shown in FIG. 18, a lower portion of the nipping element 70 and the outer nipping surface of the rollers 44*a*–44*d* form a nip for the end portion of sheet material from the stub roll S only. The sheet material is dispensed from the stub roll S in the same way in which sheet material was dispensed from the reserve roll R—by pulling the end portion of sheet material extending from the dispensing outlet 38, or by pressing the lever 66 to rotate the rollers 44*a*–44*d*. As the diameter of the stub roll S is reduced, the contact element 86 is biased against the outer surface of the stub roll S and pivots toward the stub roll S, as shown in FIGS. 19 and 20. The biasing of the contact element 86 restricts free rotation of the stub roll S and prevents upward movement of the stub roll S in the casing 16 throughout dispensing from the sub roll S. The pivoting of the contact element 86 causes the cam 88 to pivot, as shown in the views of FIGS. 19 and 20, thereby moving the cam surfaces 98*a* and 98*b* with respect to the cam followers 100*a* and 100*b*.

When almost all of the sheet material is dispensed from the stub roll S, the cam surfaces 98*a* and 98*b* move past the cam followers 100*a* and 100*b* and place the cam followers 100*a* and 100*b* out of contact with the cam surfaces 98*a* and 98*b*, as shown in FIG. 20. The biasing of the biasing elements 80*a* and 80*b* shown in FIG. 13 pivots the upper portion of the nipping element 70 toward the rollers 44*a*–44*d*, as shown in FIG. 20, to place the end portion of sheet material from the reserve roll R in the nip between the nipping element 70 and the outer nipping surface of the rollers 44*a*–44*d*. The pivoting of the nipping element 70 also causes the isolating elements 102*a* and 102*b* to retract and lower the reserve roll R into contact with the end portion of stub roll sheet material passing on the outer circumferential surface of the rollers 44*a*–44*d*.

When the nipping element 70 initially pivots toward the rollers 44*a*–44*d*, end portions of sheet material from both the reserve roll R and the stub roll S are placed in the nip, as shown in FIG. 20. When a user pulls the remaining sheets from the stub roll or actuates the lever 66 to dispense sheet material of the stub roll, the rollers 44*a*–44*d* rotate and feed the sheet material of the reserve roll R through the nip and out from the dispensing aperture 38 along with the last few sheets from the stub roll. Sheet material is then dispensed from the reserve roll R in the same manner as described above in connection with the initial roll R.

The dispensing apparatus 10 of the present invention holds a high capacity of sheet material in a compact space. The capacity of a dispenser is important to purchasers of such systems since the capacity is directly related to costs associated with refilling the dispenser with sheet material. Purchasers of sheet material dispensing systems are also concerned with the space that the sheet material dispenser occupies when in use, i.e., the wall space. The space that a dispenser occupies can be expressed in a variety of ways. One way is by the total volume that the dispenser occupies. Another way is by the projected area of the sheet material dispenser on the mounting surface, i.e., the wall area. Yet another way is by the area of the profile of the side of the dispenser, i.e., the profile area. A "capacity efficient" sheet material dispenser is one which maximizes the ratio of the sheet material volume (capacity) to the total enclosed dispenser volume. One way of evaluating the "capacity efficiency" is by calculating the ratio of the sheet material volume (capacity) to the projected area of the dispenser on the mounting surface. Another way of evaluating the "capacity efficiency" is by calculating the ratio of the sheet material volume (capacity) to the profile area of the side of the dispenser. In effect, the maximum amount of sheet material in the smallest amount of space is ideal.

In one aspect of the invention, the stub roll S and reserve roll R are rotatably positioned in the apparatus 10, the sheet material of the rolls has a width of at least about 5 inches, and the ratio, expressed as a percentage, of the maximum sheet material volume to the total enclosed volume of the apparatus 10 is preferably at least about 35%, more preferably at least about 40%, and most preferably at least about 45%.

In another aspect of the invention, the stub roll S and reserve roll R are rotatably positioned in the apparatus 10, the sheet material of the rolls has a width of at least about 5 inches, and the ratio of the maximum sheet material volume expressed in cubic inches to the projected area of the apparatus 10 on the mounting surface expressed in square inches is preferably at least about 3.0 cubic inches/square inch, more preferably at least about 3.1 cubic inches/square inch, and most preferably at least about 3.2 cubic inches/square inch.

In a further aspect of the invention, the stub roll S and reserve roll R are rotatably positioned in the apparatus 10, the sheet material of the rolls has a width of at least about 5 inches, and the ratio of the maximum sheet material volume expressed in cubic inches to the side profile area of the apparatus 10 expressed in square inches is preferably at least about 4.5 cubic inches/square inch, more preferably at least about 5.0 cubic inches/square inch, and most preferably at least about 5.5 cubic inches/square inch.

In a majority of the areas where sheet material dispensers are typically used, dispensers that produce a low sound level are preferable, particularly in health care facilities and office buildings. The sound level produced by the sheet material dispenser can be magnified depending on the mounting surface material and construction and dispensing environment. Therefore, it is desirable to have a sheet material dispenser that minimizes the sound produced when it is used to dispense sheet material. Known sheet material dispensers were compared to the apparatus 10 of the present invention to determine the level of sound generated when a segment of sheet material was dispensed from the dispensers. The sound was measured in decibels (dBA).

FIG. 25 illustrates the testing conditions used to measure the sound level of the apparatus 10 of the present invention and to measure the sound level of commercial dispensers in tests described below. Each sheet material dispenser was securely mounted to a portable stand 200 constructed of ¾" thick plywood. The tests were performed in a soundproof enclosure manufactured by: Industrial Acoustics Co., Bronx, N.Y., Model IC 250 Mini Booth. A dosimeter 210, such as the Permissible Noise Dosimeter manufactured by Quest Electronics, Model Micro-14, was used to record the maximum sound level detected during each dispensing trial. The dosimeter 210 was placed five inches from the center of the dispenser outlet. Ten readings were taken and averaged for each dispenser. A similar type of sheet material was dispensed from each dispenser within a given example.

The apparatus 10 of the present invention produces a maximum sound level preferably less than about 81 dBA, more preferably less than about 79 dBA, and most preferably less than about 76 dBA, when dispensing sheet material therefrom.

EXAMPLE 1

| Recorded Sound Level in dBA | | | |
|---|---|---|---|
| Dispensing Trial | Dispenser A | Dispenser B | Dispenser 1 |
| 1 | 84.7 | 84.3 | 72.7 |
| 2 | 88.5 | 84.3 | 77.6 |
| 3 | 85.5 | 86.2 | 75.3 |
| 4 | 82.5 | 85.5 | 75.3 |
| 5 | 87.7 | 84.3 | 75.7 |
| 6 | 85.1 | 87.3 | 78.3 |
| 7 | 87.0 | 85.5 | 76.5 |
| 8 | 87.0 | 82.8 | 77.6 |

-continued

| Recorded Sound Level in dBA | | | |
|---|---|---|---|
| Dispensing Trial | Dispenser A | Dispenser B | Dispenser 1 |
| 9 | 88.5 | 82.1 | 75.3 |
| 10 | 87.0 | 85.5 | 76.5 |
| Avg. | 86.4 | 84.8 | 76.1 |
| Std. Dev. | 1.89 | 1.55 | 1.60 |

Example 1 illustrates a comparison of the compilation of test results of the recorded maximum sound level of individual towel dispensing from different dispensers in a controlled acoustical environment. Comparative Dispensers A and B are commercially available dispensers each including a rotating cut off roll. A rotating cut-off roll is a roller containing a knife or blade that is activated once per revolution to cut the sheet. Non-perforated white paper roll toweling was dispensed from Dispensers A and B. Dispenser 1 is a dispensing apparatus according to the present invention. Perforated white paper roll toweling was dispensed from Dispenser 1.

EXAMPLES 2 AND 3

| Recorded Sound Level in dBA | | |
|---|---|---|
| Dispensing Trial | Example 2 | Example 3 |
| 1 | 81.3 | 79.1 |
| 2 | 80.6 | 71.6 |
| 3 | 82.5 | 78.7 |
| 4 | 81.7 | 74.6 |
| 5 | 81.7 | 71.6 |
| 6 | 78.7 | 77.6 |
| 7 | 80.6 | 75.7 |
| 8 | 81.3 | 79.1 |
| 9 | 83.2 | 75.7 |
| 10 | 81.3 | 75.7 |
| Avg. | 81.3 | 75.9 |
| Std. Dev. | 1.20 | 2.78 |

Examples 2 and 3 illustrate a compilation of test results of the recorded maximum sound level of individual towel dispensing in a controlled acoustical environment. Examples 2 and 3 were performed with Dispenser 1 of Example 1. The same perforated white paper roll toweling used in Dispenser 1 of Example 1 was dispensed from Dispenser 1 in Example 3. Brown perforated paper roll toweling having a higher tensile modulus than the white paper toweling used in Example 3 was dispensed from Dispenser 1 in Example 2.

EXAMPLE 4

| | Dispenser 1 | Dispenser C | Dispenser D | Dispenser E |
|---|---|---|---|---|
| v/tev | 43% | 32% | 28% | 27% |
| v/pa | 3.2 | 2.9 | 2.2 | 2.1 |
| v/spa | 5.7 | 4.1 | 3.4 | 3.3 |

In Example 4, the capacity efficiency of Dispenser 1 according to the present invention and comparative Dispensers C, D, and E was calculated. Comparative Dispenser C is a dispenser described in U.S. patent application Ser. No. 08/384,923, filed on Feb. 7, 1995. Comparative Dispensers D and E are commercially available dispensers each including a rotating cut off roll. The Maximum Sheet Material Volume per Total Enclosed Volume (v/tev) is expressed as a percentage. The ratio of Maximum Sheet Material Volume to Projected Area (v/pa) is expressed in cubic inches/square inch. The ratio of Maximum Sheet Material Volume to Side Profile Area (v/spa) is expressed in cubic inches/square inch.

It will be apparent to those skilled in the art that various modifications and variations can be made to the structure and methodology of the present invention without departing from the scope or spirit of the invention. In view of the foregoing, it is intended that the present invention cover modifications and variations of this invention provided they fall within the scope of the following claims and their equivalents.

What is claimed is:

1. An apparatus for dispensing sheet material, the apparatus comprising:

a housing defining an interior for accommodating a quantity of sheet material therein and an outlet through which the sheet material is dispensed, the housing comprising a first housing member, a second housing member, and at least one hinge member allowing the first housing member to pivot with respect to the second housing member between a closed position limiting access to the interior of the housing and an open position allowing access to the interior of the housing;

a latch on the housing for selectively retaining the first housing member in the closed position; and at least one biasing element cooperating with the first and second housing members, the biasing element biasing the first housing member toward the closed position when the first housing member moves to the open position so as to limit free movement of the first housing member to the open position.

2. The apparatus of claim 1, wherein the first housing member is a front cover and the second housing member is a casing, and wherein the hinge member couples the front cover to the housing member at a lower portion of the front cover.

3. The apparatus of claim 1, further comprising at least one roller and a nipping element in the housing, the nipping element cooperating with the roller to form a nip for the sheet material.

4. The apparatus of claim 3, further comprising at least one biasing element biasing the nipping element toward the roller.

5. The apparatus of claim 3, wherein one of the nipping element and the roller is located in the first housing member and the other of the nipping element and the roller being is in the second housing member such that the nipping element and the roller form the nip for the sheet material when the first housing member is in the closed position and such that the nip opens when the first housing member is in the open position.

6. The apparatus of claim 3, further comprising a movable lever cooperating with the roller so that movement of the lever rotates the roller.

7. The apparatus of claim 1, further comprising at least one roll of wound sheet material for being placed in the interior of the housing.

8. The apparatus of claim 7, wherein the sheet material is perforated.

9. The apparatus of claim 7, wherein the sheet material comprises a web of wound sheet material having two side edges, a terminal end, and an initial end, the sheet material being divided into a plurality of individual sheets by a plurality of perforation tear lines including frangible bonds spaced along the tear line and extending from one edge to the other.

10. The apparatus of claim 1, wherein the outlet has a width narrower than a width of the sheet material.

11. An apparatus for dispensing sheet material from at least one source of sheet material, the apparatus comprising:

a housing defining an interior for accommodating at least one source of sheet material therein and an outlet through which the sheet material is dispensed;

at least one roller in the housing;

a nipping element cooperating with the roller to form a nip between the nipping element and the roller for passage of the sheet material; and a lever coupled to the housing and cooperating with the roller so that moving the lever rotates the roller, the lever being located with respect to the outlet so that sheet material dispensed through the outlet passes substantially over the lever.

12. The apparatus of claim 11, wherein the lever includes a surface having at least one protuberance, the protuberance guiding the sheet material when the sheet material is dispensed through the outlet.

13. The apparatus of claim 11, wherein the housing includes a first section for accommodating a stub roll of sheet material and a second section for accommodating a reserve roll of sheet material, the lever being pivotally movable with respect to the housing to allow an unused portion of the stub roll to be removed from the first section of the housing without removing the reserve roll from the second section.

14. The apparatus of claim 11, further comprising a clutch mechanism coupled to the roller and cooperating with the lever, the clutch mechanism allowing rotation of the roller independent of the moving of the lever so that the sheet material may be manually dispensed through the outlet.

15. The apparatus of claim 11, further comprising a roll of sheet material for being placed in the interior of the housing.

16. The apparatus of claim 15, wherein the sheet material is perforated.

17. The apparatus of claim 15, wherein the sheet material comprises a web of wound sheet material having two side edges, a terminal end, and an initial end, the sheet material being divided into a plurality of individual sheets by a plurality of perforation tear lines including frangible bonds spaced along the tear line and extending from one edge to the other.

18. The apparatus of claim 11, wherein the outlet has a width narrower than a width of the sheet material.

* * * * *

UNITED STATES PATENT AND TRADEMARK OFFICE

CERTIFICATE OF CORRECTION

PATENT NO. : 6,412,678 B2
DATED : July 2, 2002
INVENTOR(S) : Dale T. Gracyalny et al.

It is certified that error appears in the above-identified patent and that said Letters Patent is hereby corrected as shown below:

Column 21,
Line 52, please delete "being".

Signed and Sealed this

Seventeenth Day of December, 2002

JAMES E. ROGAN
*Director of the United States Patent and Trademark Office*